US010059542B2

(12) United States Patent
Ikegami

(10) Patent No.: US 10,059,542 B2
(45) Date of Patent: Aug. 28, 2018

(54) SHEET TRAY AND IMAGE FORMING APPARATUS EMPLOYING SHEET TRAY

(71) Applicant: Brother Kogyo Kabushiki Kaisha, Nagoya (JP)

(72) Inventor: Yusuke Ikegami, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/460,737

(22) Filed: Mar. 16, 2017

(65) Prior Publication Data

US 2017/0283195 A1 Oct. 5, 2017

(30) Foreign Application Priority Data

Mar. 31, 2016 (JP) ..... 2016-071780

(51) Int. Cl.
*B65H 1/04* (2006.01)

(52) U.S. Cl.
CPC ..... *B65H 1/04* (2013.01); *B65H 2405/1122* (2013.01); *B65H 2405/11164* (2013.01)

(58) Field of Classification Search
CPC .... B65H 1/04; B65H 31/20; B65H 2405/111; B65H 2405/1113; B65H 2405/1116; B65H 2405/11164; B65H 2405/1122; B65H 2405/1412; B65H 2402/343; B65H 2402/344
See application file for complete search history.

(56) References Cited

U.S. PATENT DOCUMENTS

| | | | | |
|---|---|---|---|---|
| 8,186,671 | B2 * | 5/2012 | Nishiyama | B65H 1/266 271/167 |
| 8,919,765 | B2 * | 12/2014 | Kawashima | B65H 3/0684 271/126 |
| 9,004,484 | B2 * | 4/2015 | Murakami | B65H 1/04 271/145 |
| 2010/0124449 | A1 * | 5/2010 | Asada | B65H 1/04 399/393 |

FOREIGN PATENT DOCUMENTS

| | | |
|---|---|---|
| JP | H04-24557 U | 2/1992 |
| JP | H05-278868 A | 10/1993 |
| JP | 2011-235986 A | 11/2011 |

* cited by examiner

*Primary Examiner* — Michael C McCullough
(74) *Attorney, Agent, or Firm* — Burr & Brown, PLLC

(57) ABSTRACT

A sheet tray provided with first and second trays respectively having first and second supporting surfaces. The second tray slidably assembled, in a first direction, to the first tray. The first and second supporting surfaces are configured to support sheets thereon. The first tray and the second tray have a first guide portion and a second guide portion which are formed at central parts, in a second direction perpendicular to the first direction, respectively. The second guide portion is configured to slidably contact the first guide portion to guide the slide movement of the second tray. A first separation regulating part formed on the first guide portion, and a second separation regulating part formed on the second guide portion are configured to engage with each other in the vertical direction to prevent separation of the first and second trays in the vertical direction, exceeding a particular dimension.

13 Claims, 19 Drawing Sheets

SHEET TRAY AND IMAGE FORMING APPARATUS EMPLOYING SHEET TRAY

CROSS-REFERENCE TO RELATED APPLICATION

This application claims priority under 35 U.S.C. § 119 from Japanese Patent Application No. 2016-071780 filed on Mar. 31, 2016. The entire subject matter of the application is incorporated herein by reference.

BACKGROUND

Technical Field

The present disclosures relate to an extendable sheet tray for mounting sheets, and an image forming apparatus employing such a sheet tray.

Related Art

Conventionally, an extendable sheet tray has been known. For example, there has been known an image forming apparatus having a sheet tray including a first tray, a second tray which is configured to be slidably displaceable with respect to the first tray, and rail-like guide members arranged at both sides, in a width direction, of the second tray to guide the second tray to be slidably displaced.

SUMMARY

Sheets are mounted on the sheet trays and a load applied, by the sheets, to the sheet tray can be regarded as a uniformly distributed load. Therefore, if the sheet tray is supported only at ends thereof in the width direction, deflection deformation is larger at a central portion, in the width direction, of the sheet tray than at the end portions.

Therefore, when the sheet trays are configured as described above, and the second tray is extended with respect to the first tray, there is a possibility that a relatively large clearance is formed between the central portions, in the width direction, of the first tray and the second tray.

According to aspects of the disclosures, there is provided a sheet tray having a first tray having a first supporting surface facing upward in a vertical direction, and a second tray assembled to the first tray, the second tray having a second supporting surface facing upward in the vertical direction and configured to supports the sheets thereon in association with the first supporting surface. The first tray has a first guide portion which is formed at a central part, in a second direction which is a direction perpendicular to a first direction and parallel to the first supporting surface, of the first tray, the first direction being parallel to the first supporting surface, the first guide portion being configured to guide a slide movement of the second tray with respect to the first tray in the first direction, at least one first separation regulating part being formed on the first guide portion. The second tray has a second guide portion which is formed at a central part, in the second direction, of the second tray, the second guide portion being configured to slidably contact the first guide portion to guide the slide movement of the second tray with respect to the first tray at least one second separation regulating part being formed on the first guide portion. The at least one first separation regulating part and the at least one second separation regulating part are configured to engage with each other in the vertical direction to prevent separation of the second tray with respect to the first tray exceeding a particular dimension.

According to aspects of the disclosures, there is provided an image forming apparatus, which has an image forming device configured to form an image on a sheet, a main body configured to accommodate the image forming device therein, and a sheet tray. The sheet tray is provided with a first tray assembled to the main body, the first tray having a first supporting surface facing upward in a vertical direction, and a second tray assembled to the first tray, the second tray having a second supporting surface facing upward in the vertical direction and configured to supports the sheets thereon in association with the first supporting surface. The first tray has a first guide portion which is formed at a central part, in a second direction which is a direction perpendicular to a first direction and parallel to the first supporting surface, of the first tray, the first direction being parallel to the first supporting surface, the first guide portion being configured to guide a slide movement of the second tray with respect to the first tray in the first direction, at least one first separation regulating part being formed on the first guide portion. The second tray has a second guide portion which is formed at a central part, in the second direction, of the second tray, the second guide portion being configured to slidably contact the first guide portion to guide the slide movement of the second tray with respect to the first tray at least one second separation regulating part being formed on the first guide portion. The at least one first separation regulating part and the at least one second separation regulating part are configured to engage with each other in the vertical direction to prevent separation of the second tray with respect to the first tray exceeding a particular dimension. The image forming apparatus further includes a sheet feeder configured to feed the sheet supported by the sheet tray from a sheet feed port formed on the housing toward the image forming device.

BRIEF DESCRIPTION OF THE ACCOMPANYING DRAWINGS

DETAILED DESCRIPTION OF EMBODIMENTS

Figure 1:
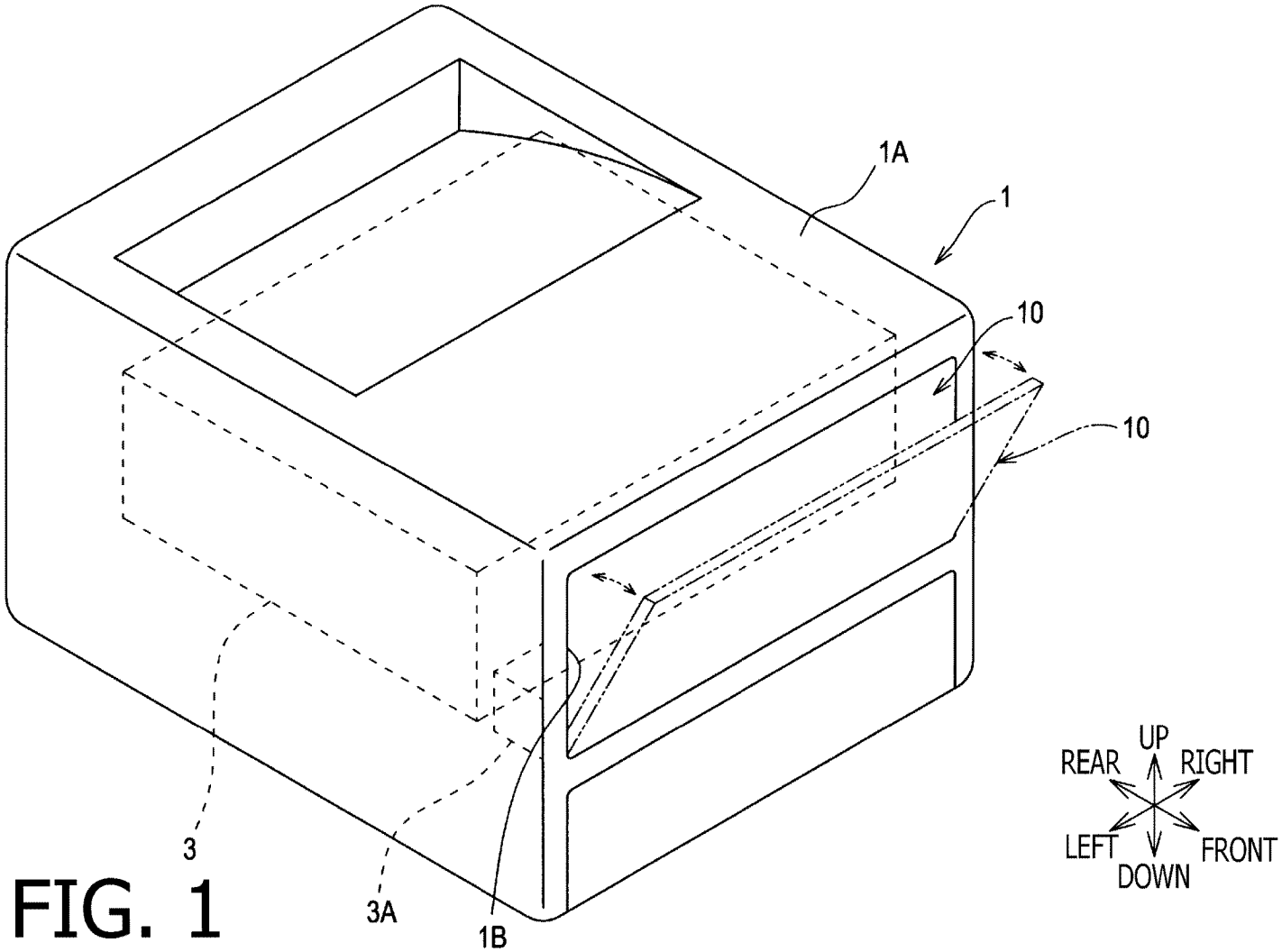
FIG. 1 is a perspective view of an image forming apparatus according to an illustrative embodiment of the disclosures.

It is noted that embodiments described below are examples of embodiments related to technical scope of the present disclosures. Therefore, inventions set forth in claims should not be limited to configurations of the embodiments.

Hereinafter, referring to the accompanying drawings, illustrative embodiments according to the disclosures will be described. In each drawing, arrows indicating directions are shown in order to clarify directional relationships among the drawings. It is noted that the indicated directions are only examples and are not intended to limit the directions in relation to an image forming apparatus or a sheet tray as disclosed.

Further, the number of each of components and portions to which a reference numeral is assigned should be considered as at least one, unless explicitly indicated to be "multiple," "more than one" or the like.

<First Illustrative Embodiment>

1. General Description of Image Forming Apparatus

Firstly, an electrophotographic image forming apparatus 1 to which an image forming apparatus and a sheet tray according to a first illustrative embodiment are applied will be described. The image forming apparatus 1 has a main body 1A which includes an image formation device 3 as shown in FIG. 1.

In this description, the term "main body" 1A includes portions which are not normally disassembled by a user when the image forming apparatus 1 is normally used. The image formation device 3 is configured to form an image on a sheet. According to the first illustrative embodiment, the image formation device 3 is configured to form monochromatic images.

A feeding port 1B is formed on the main body 1A. the feeding port 1B is a sheet supplying opening from which the sheet is supplied toward the image formation device 3. At the feeding port 1B, a sheet tray 10 according to the first illustrative embodiment is assembled. The sheet tray 10 is a member configured to support sheets to be fed toward the image formations device 3 from a lower side in the vertical direction.

At a feeding port 1B side inside the main body 1A, a feeder 3A is provided. The feeder 3A is configured to feed the sheets supported on the sheet tray 10 toward the image formation device 3. The sheet tray 10 is assembled to the main body 1A so as to be rotatable between a closed position (indicated by a solid line in FIG. 1) and an opened position (indicated by a two-dotted line in FIG. 1).

The closed position is a position at which the sheet tray 10 closes the feeding port 1B (i.e., the feeding port 1B is covered with the sheet tray 10), while the opened position is a position at which the sheet tray 10 opens the feeding port 1B (i.e., the feeding port 1B is exposed to outside). When the sheet tray 10 is fully rotated (i.e., opened), the sheet tray 10 is oriented such that a surface of the sheet tray 10 extends substantially in a horizontal direction. With this configuration, the sheet tray 10 serves as a so-called multi-purpose sheet feed tray.

2. Structure of Sheet Tray 2.1 General Description of Sheet Tray

The sheet tray 10 according to the first embodiment includes a first MP (multi-purpose) tray 11, a second MP tray 12, a third MP tray 13, rotatable trays 14 and a grip 15. The first MP tray 11, the second MP tray 12 and the third MP tray 13 have a first supporting surface 11A, a second supporting surface 12A and a third supporting surface 13A configured to support the sheets on upper surfaces thereof, respectively.

The first MP tray 11 is assembled to the main body 1A, while the second MP tray 12 is assembled to the first MP tray 11 and the third MP tray 13 is assembled to the second MP tray 12.

Figure 2:
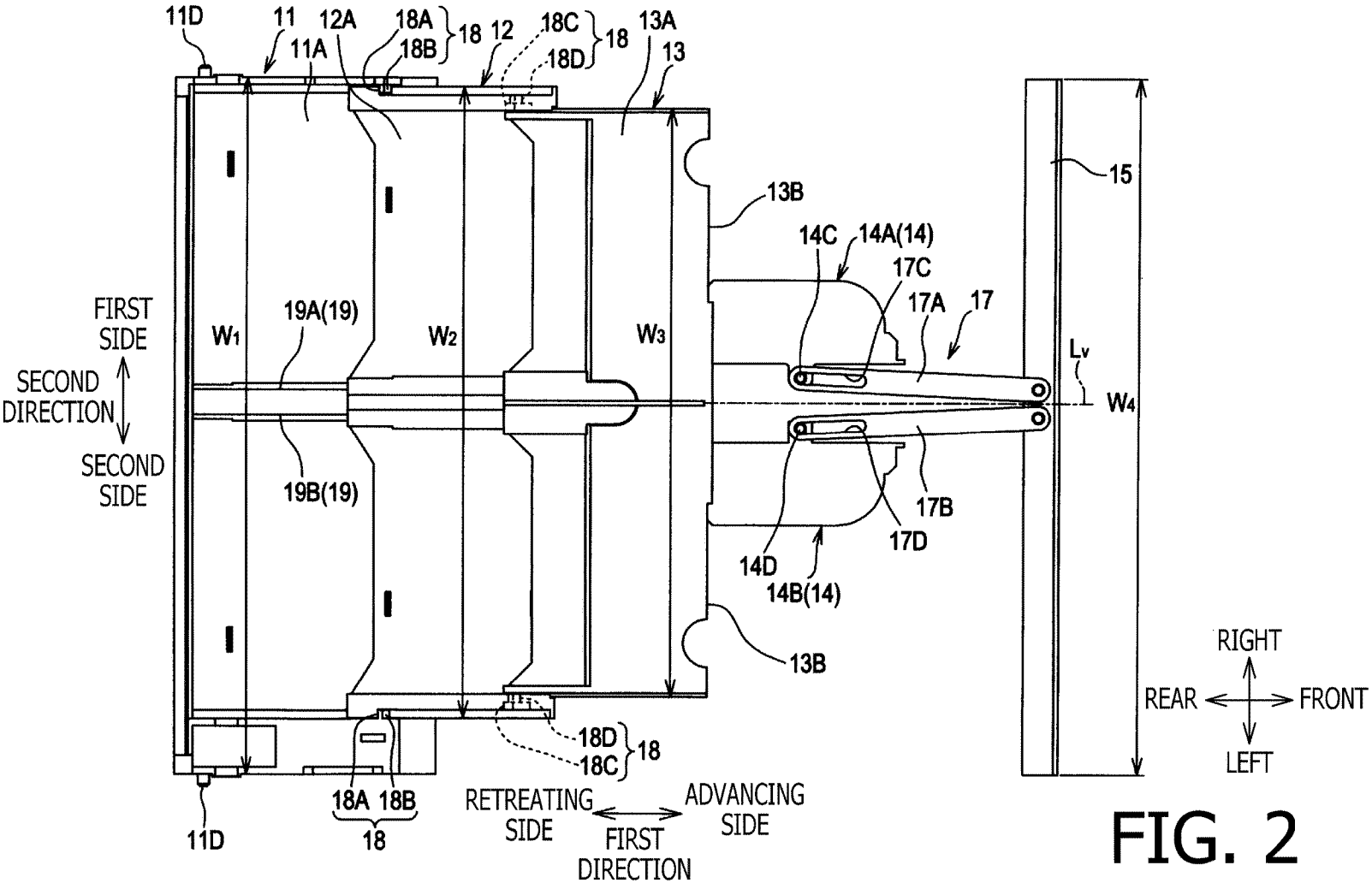
FIG. 2 shows a state where a sheet tray is extended according to a first illustrative embodiment of the disclosures.

Further, the second MP tray 12 is configured to be slidable in a first direction with respect to the first MP tray 11 (see FIG. 2), and the third MP tray 13 is configured to be slidable in the first direction with respect to the first MP tray 11 (see FIG. 2).

It is noted that the first direction is a direction parallel to the second supporting surface 12A. The first supporting surface 11A, the second supporting surface 12A and the third supporting surface 13A are substantially parallel to each other. Therefore, the first direction is also parallel to the first supporting surface 11A and the third supporting surface 13A.

2.2 Structure of Rotatable Tray

The rotatable trays 14 are plate-like members configured to be rotatable within a plane parallel to the third supporting surface 13A. The rotatable trays 14 are assembled to an advancing side end (see FIG. 2), in the first direction, of the third MP tray 13 (i.e., to an end opposite to the second supporting surface 12A) with the third supporting surface 13A arranged therebetween.

It is noted that the advancing side in the first direction is a moving direction, in the first direction, in which the third MP tray 13 slides to move away from the second MP tray 12. That is, the rotatable tray 14 is arranged on the front end 13B side of the third MP tray 13.

On an advancing side end portion of the third MP tray 13 in the first direction, that is, on the front end 13B of the third MP tray 13, an enclosure 16 capable of accommodating the rotatable trays 14 is provided.

The rotatable trays 14 are configured to be rotatable between an accommodated position (see FIGS. 3 and 5) at which the rotatable trays 14 are accommodated in the enclosure 16 (i.e., the third MP tray 13) and a supporting position (see FIGS. 2 and 4) which is shifted from the accommodated position.

Figure 6:
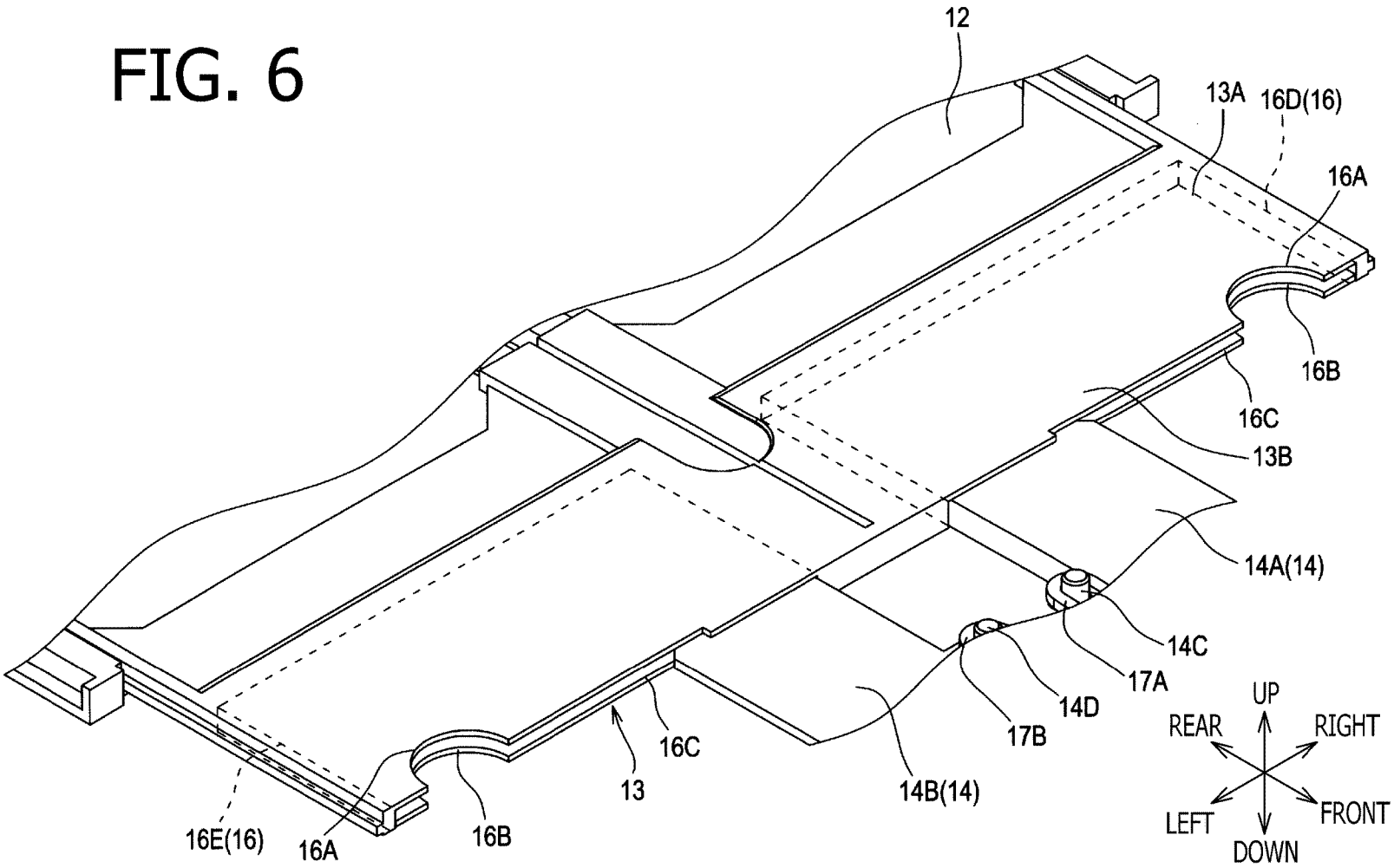
FIG. 6 is a perspective view showing a front end portion of the sheet tray according to the first illustrative embodiment of the disclosures.

The rotatable trays 14 according to the first illustrative embodiment include a belt-like first rotatable tray 14A and a belt-like second rotatable tray 14B. As shown in FIG. 6, the enclosure 16 has a first enclosure 16D for accommodating the first rotatable tray 14A and a second enclosure 16E for accommodating the second rotatable tray 14B.

Figure 3:
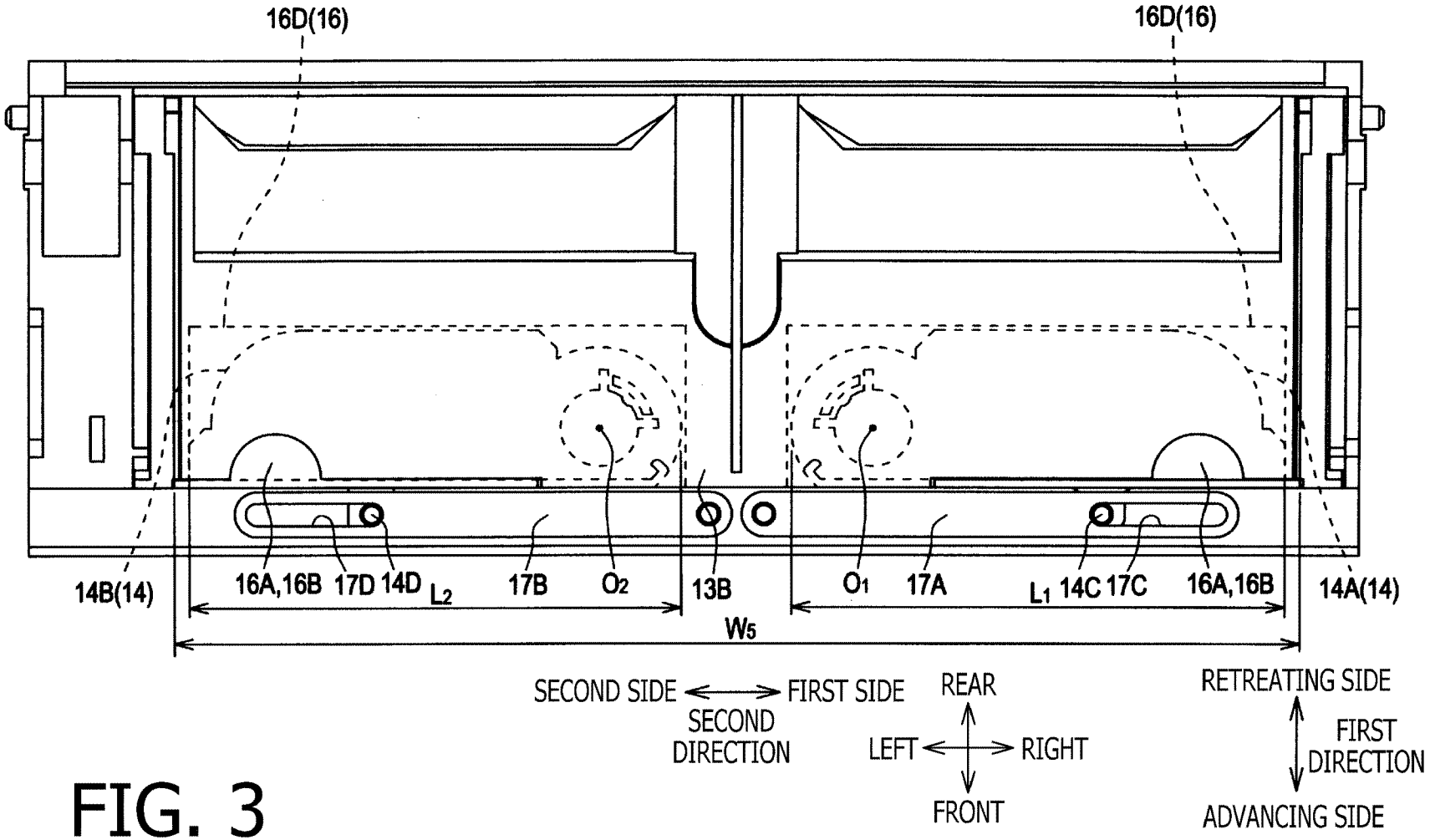
FIG. 3 shows a state where the sheet tray is retracted according to the first illustrative embodiment of the disclosures.

A center O1 of rotation of the first rotatable tray 14A and a center O2 of rotation of the second rotatable tray 14B are arranged at central portions in an second direction of the third MP tray 13 (see FIG. 3). It is noted that the second direction is a direction perpendicular to the first direction and parallel to the second supporting surface 12A.

Further, each of a dimension L1, in a longitudinal direction, of the first rotatable tray 14A and a dimension L2, in a longitudinal direction, of the second rotatable tray 14B is equal to or less than half of a dimension W5, in the second direction, of the third MP tray 13. It is noted that, according to the first embodiment, the first enclosure 16D does not communicate with the second enclosure 16E. That is, the first enclosures 16D and the second disclosure 16E form spaces isolated from each other.

In the following description, a term "rotatable trays 14" is used to collectively represent both the first rotatable tray 14A and the second rotatable tray 14B. Further, in the following description, a term "enclosure 16" is used to collectively represent both the first enclosure 16D or the second enclosure 16E.

On a supporting surface 13A side of the enclosure 16, first through openings 16A communicating with inside of the enclosure 16 are formed. It is noted that the first through openings 16A are formed by cutting out front end 13B side part of the third MP tray 13, at right and left end portions, to define U-shaped cutouts opened toward the front side.

On a side opposite to the third supporting surface 13A, that is, on a lower surface in the vertical direction of the third MP tray 13, second through openings 16B communicating with the enclosure 16 are formed. It is noted that the second through openings 16B are formed by cutting out a front end 13B side part of the third MP tray 13, at right end left portions, to define U-shaped cutouts opened toward the front side.

The second through openings 16B are formed on the lower surface, in the vertical direction, of the third MP tray 13 and at positions facing the first through openings 16A, respectively. It is noted that the enclosure 16 according to the first embodiment includes the third supporting surface 13A, and a cover 16C assembled to the third MP tray 13 from an opposite side to the third supporting surface 13A.

2.3 Structure of Grip

Figure 4:
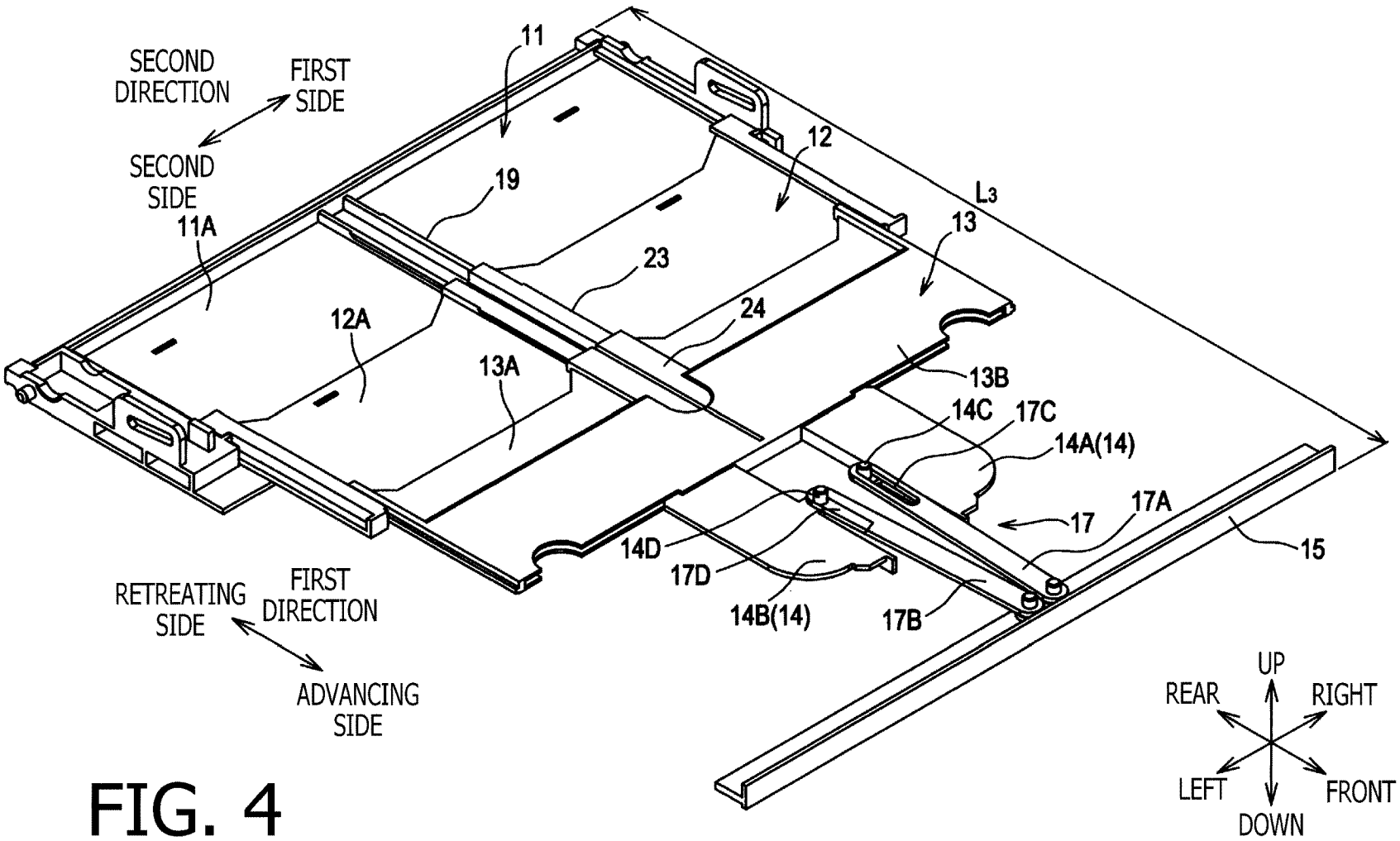
FIG. 4 is a perspective view showing the state where the sheet tray is extended according to a first illustrative embodiment of the disclosures.

The grip 15 is connected to the rotatable tray 14 through a link mechanism 17 as shown in FIG. 4. The grip 15 is an example of a handle which can be gripped/operated by the user. The grip 15 is a member extending in the second direction and having a substantially L-shaped or T-shaped cross section when viewed along the second direction.

A longitudinal dimension W4 of the grip 15 could be equal to, or as shown in FIG. 2, is less than a dimension W1 of the first MP tray 11 in the second direction. Further, a dimension W3, in the second direction, of the third MP tray 13 is less than the dimension W2, in the second direction, of the second MP tray 12.

The dimension W2, in the second direction, of the second MP tray 12 is less than the dimension W1, in the second direction, of the first MP tray 11. Further, the dimension W4, in the longitudinal direction, of the grip 15 is greater than the dimension W3, in the second direction, of the third MP tray 13.

The link mechanism 17 connects the rotatable trays 14 with the grip 15 at positions displaced from the centers O1 and O2 of rotation of the rotatable trays 14, thereby a force, in the advancing direction in the first direction, applied to the grip 15 being converted forces to move the rotatable trays 14 from the accommodated positions toward the supporting positions.

As shown in FIG. 4, the link mechanism 17 has a first link member 17A and a second link member 17B. The first link member 17A connects the first rotatable tray 14A with the grip 15, and the second link member 17B connects the second rotatable tray 14B with the grip 15.

The first link member 17A and the second link member 17B are rotatably connected with the grip 15. The first link member 17A and the first rotatable tray 14A are connected with a cylindrical protruding member 14C fitted in an elongated hole 17C formed on the first link member 17A.

The elongated hole 17C is a hole formed on the first link member 17A and having an elongated circular shape extending in the longitudinal direction of the first link member 17A. The protruding member 14C is disposed to the first rotatable tray 14A and slidably engages with the elongated hole 17C so as to be displaceable in a direction of a longer diameter of the elongated hole 17C.

A structural relationship between the second link member 17B and the second rotatable tray 14B is similar to the structural relationship between the first link member 17A and the first rotatable tray 14A described above. The second link member 17B has an elongated hole 17D and a cylindrical protruding member 14D slidably fitted in the elongated hole 17D.

Figure 5:
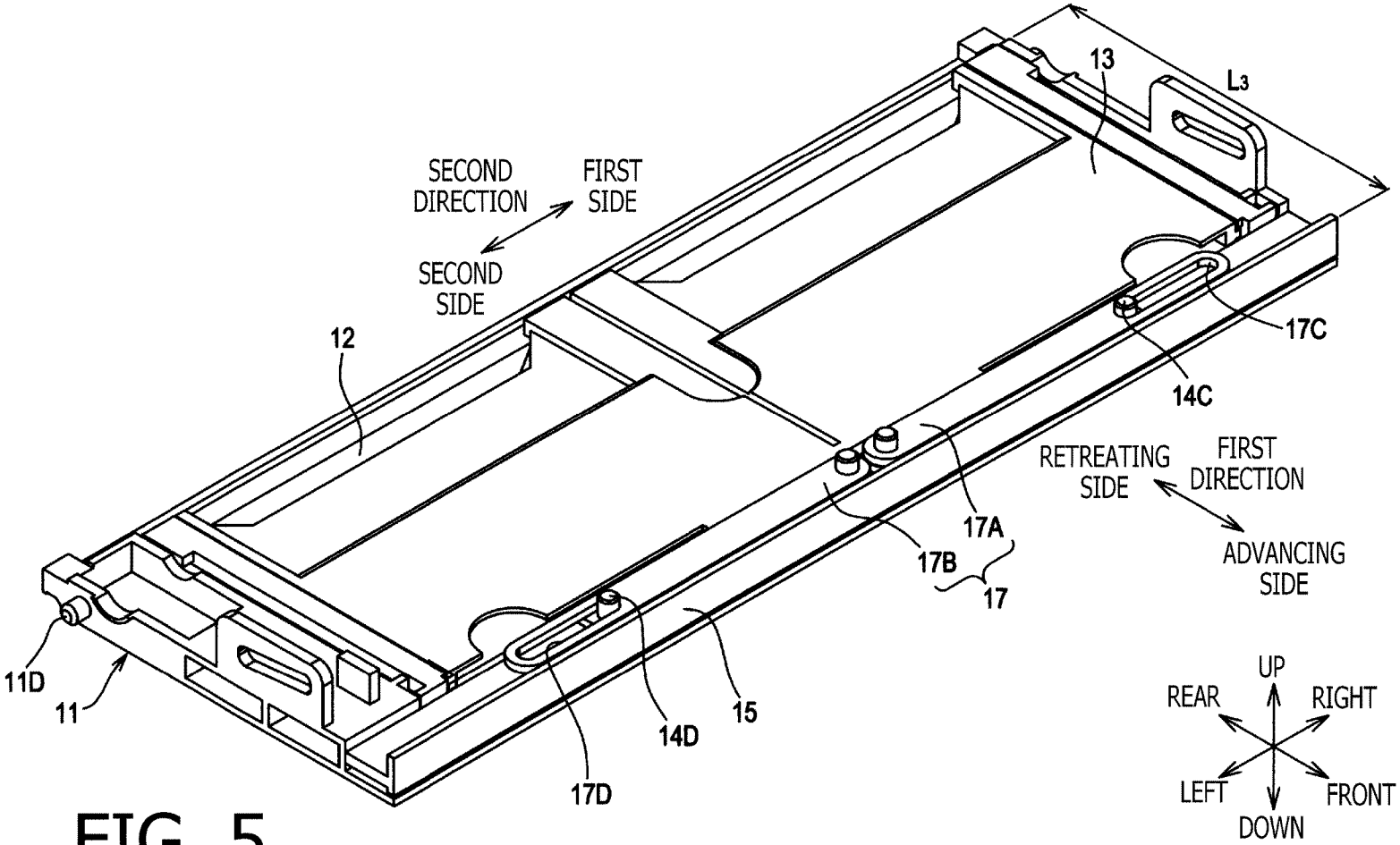
FIG. 5 is a perspective view showing the state where the sheet tray is retracted according to the first illustrative embodiment of the disclosures.

When the rotatable trays 14 are located at the accommodated positions, the first link member 17A and the second link member 17B are oriented such that the longitudinal direction of the first link member 17A and the second link member 17B is parallel to the longitudinal direction of the grip 15 (see FIG. 5). When, for example, the grip 15 is pulled by the user toward the advancing side in the first direction, in association of the displacement of the grip 15, the rotatable trays 14 rotate to approach the supporting positions, and the first link member 17A and the second link member 17B move to approach a parallel state (see FIG. 4).

According to the present embodiment, the link mechanism 17 is configured such that the centers of rotation of the link members 17A and 17B on the grip 15 are arranged to be closer to a virtual bisector Lv, which bisects the sheet tray 10 in the right-left direction, than the protruding members 14C and 14D when the rotatable trays 14 are located at the supporting positions as shown in FIG. 2. Therefore, when the grip 15 is pushed toward the retreating side in the first direction, the force applied to the grip 15 and directed to a retreating side in the first direction is converted into a force to move the rotatable trays 14 from the supporting positions to the accommodated positions. It is noted that the retreating side in the first direction is a side opposite to the advancing side in the first direction.

2.4 Structures of First, Second and Third MP Trays

Figure 7:
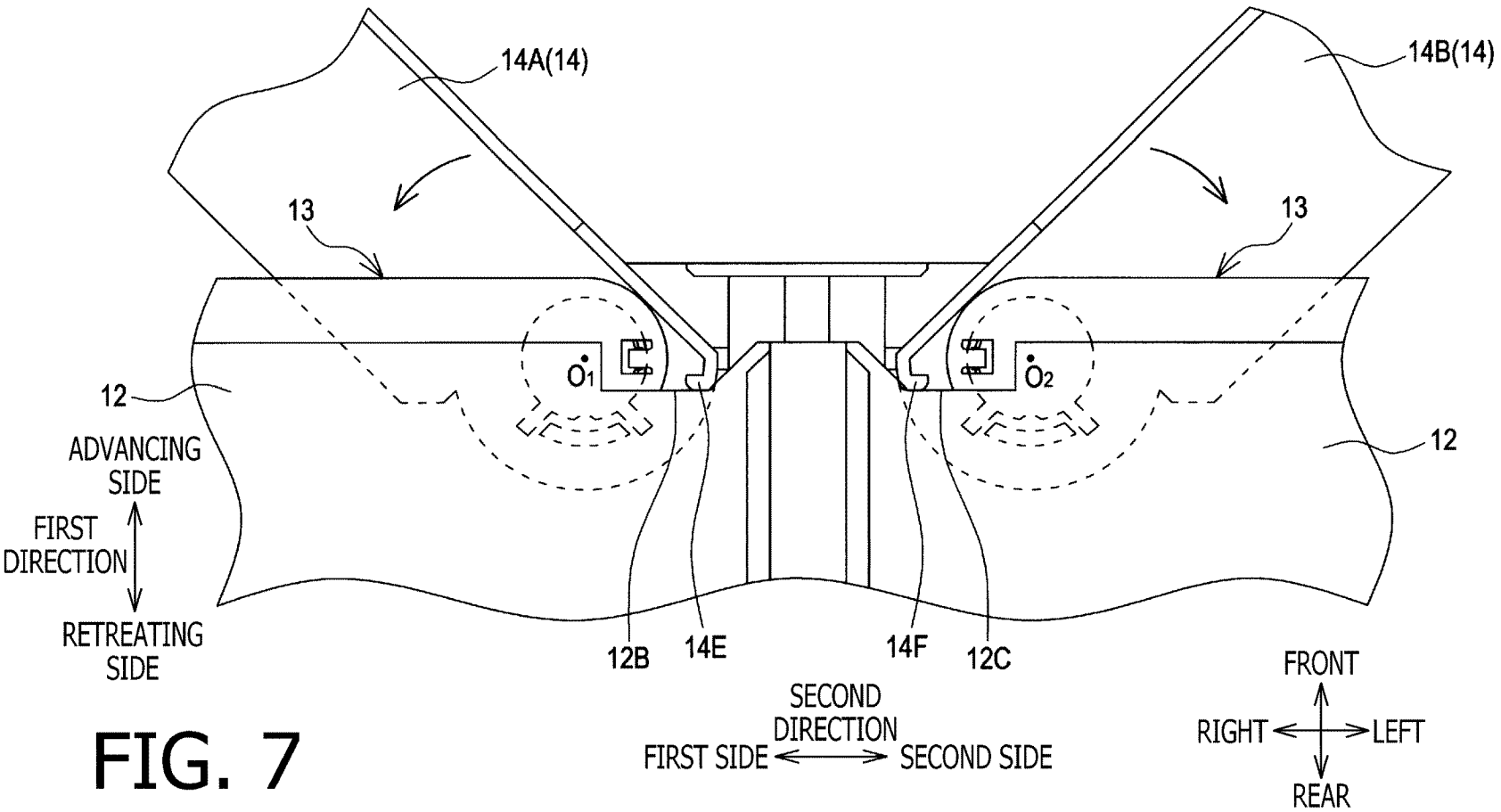
FIG. 7 is s plan view showing a part of the front end portion of the sheet tray according to the first illustrative embodiment of the disclosures.

As shown in FIG. 7, the second MP tray 12 is provided with slidable parts 12B and 12C which are configured to slidably contact sliding contact parts 14E and 14F provided to the rotatable trays 14, respectively. The sliding contact parts 14E and 14F constitute cams that convert contact forces generated at contacting portions between the sliding contact parts 14E, 14F and the slidable parts 12B, 12C to forces effecting to rotate the rotatable trays 14 from the supporting positions to the accommodated positions, respectively. Hereinafter, such forces to rotate the rotatable trays 14 will be referred to as accommodating moments.

Figure 8:
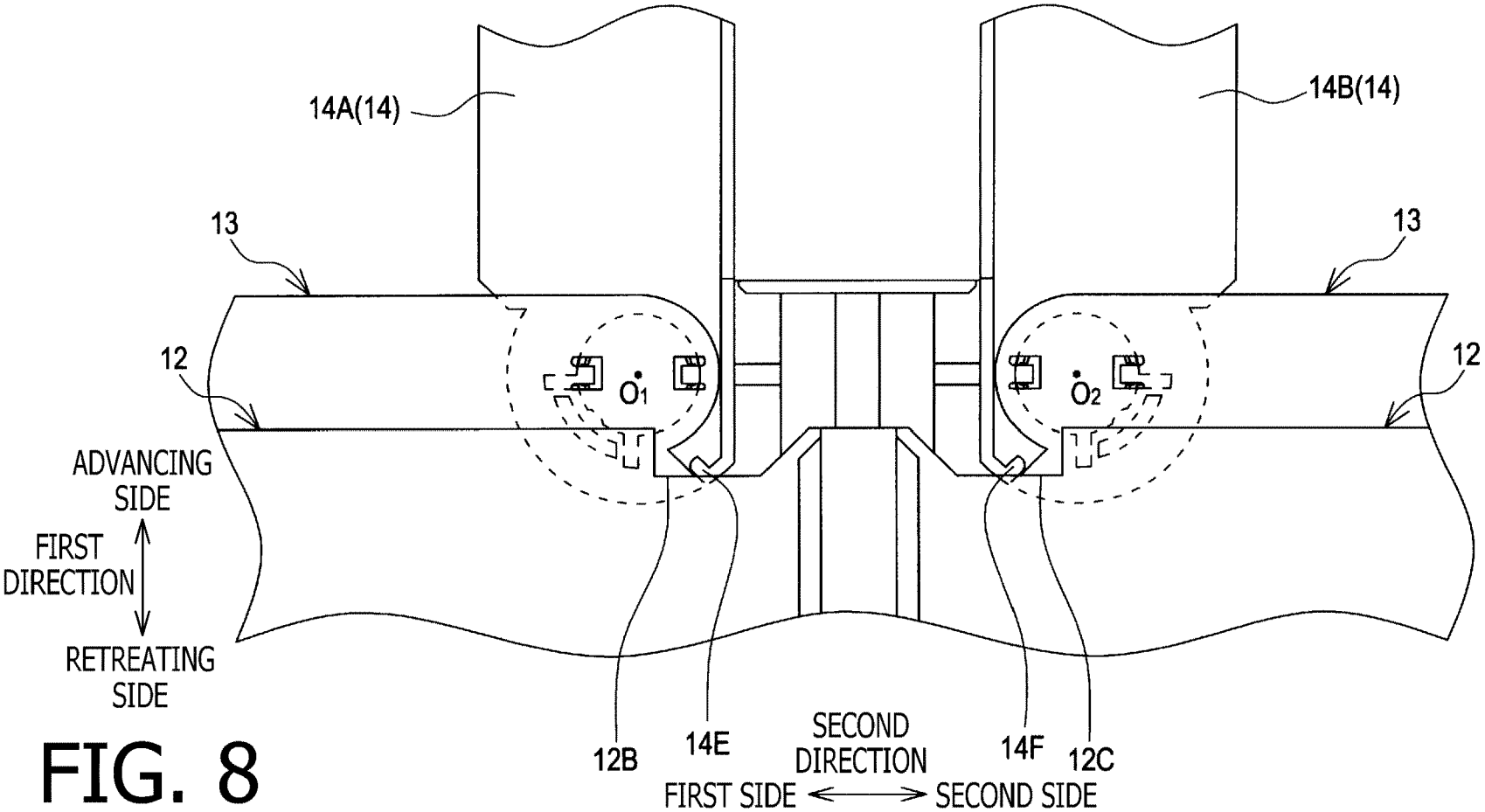
FIG. 8 is a plan view showing a part of the front end portion of the sheet tray according to the first illustrative embodiment of the disclosures.

That is, as shown in FIG. 8, the sliding contact parts 14E and 14F are formed on the longitudinal end parts of the rotatable trays 14, close to the rotation centers O1 and O2, and as the sliding contact parts 14E and 14F contact the slidable parts 12B and 12C, the contact forces are converted to the accommodating moments.

Therefore, as shown by the changes from FIG. 8 to FIG. 7, when the third MP tray 13 is moved toward the second MP tray 12 side (i.e., toward the retreating side in the first direction), the sliding contact parts 14E and 14F respectively provided to the trays 14A and 14B, which are rotatable about the rotation centers O1 and O2, contact the slidable parts 12B and 12C. When the third MP tray 13 is further pushed toward the retreating side in the first direction, the sliding contact parts 14E and 14F contact the slidable parts 12B and 12C and are pushed thereby, respectively. Since the sliding contact parts 14E and 14F are located on the inner side, in the tray width direction, with respect to the rotation centers O1 and O2, forces in the advancing direction are applied to the trays 14A and 14B. Then, a counterclockwise moment around the rotation center O1 acts on the tray 14A, while a clockwise moment around the rotation center O2 acts on the tray 14B. That is, the accommodating moments acts on the trays 14A and 14B, thereby the rotatable trays 14 (i.e., 14A and 14B) move toward the accommodated positions as shown in FIG. 7.

On a retreating side, in the first direction, of the first MP tray 11, rotation shafts 11D protruding outward in the second direction are provided on both side surfaces thereof, respectively. The first MP tray 11, or the sheet tray 10 is assembled to the feeding port 1B of the main body 1A via the pair of rotation shafts 11D.

When the sheet tray 10 is located at the opened position, the third MP tray 13 is slidable with respect to the second MP tray 12 in the first direction, and the second MP tray 12 is slidable with respect to the first MP tray 11 in the first direction.

Hereinafter, a state where the second MP tray 12 is mostly extended with respect to the first MP tray 11 in the first direction, and the third MP tray 13 is mostly extended with respect to the second MP tray 12 in the first direction, and the rotatable trays 14 are located at the supporting position will be referred to as a usage state.

Further, a state where neither the second tray 12 nor the third tray 13 are extended in the first direction and the rotatable trays 14 are located at the accommodated positions as shown in FIG. 5 will be referred to as a accommodated state. A dimension of a portion of the sheet tray 10 parallel with the first direction will be referred to as a tray length L3 (see FIGS. 4 and 5).

According to the first embodiment, a tray length L2 (see FIG. 5) when the sheet tray 10 is in the accommodated state is, for example, less than a half of the dimension of the longer side of an A4 (210 mm×297 mm) sheet, while the dimension of the tray length L3 (see FIG. 4) when the sheet tray 10 is in the usage state (FIG. 4) is, for example, equal to or greater than ⅘ of the dimension of the A4 sheet.

The first supporting surface 11A, the second supporting surface 12A and the third supporting surface 13A face vertically upward when the sheet tray 10 is in the opened position. It is noted that the sheet tray 10 is provided with a regulation mechanism 18 which regulates the dimension L2 of the sheet tray 10 from exceeding a particular length when the sheet tray 10 is in the usage state (see FIG. 2).

The regulation mechanism 18 includes, as shown in FIG. 2, first stoppers 18B, which are provided on both sides, in the second direction, of the first MP tray 11 to prevent the second MP tray 12 from further moving toward the advancing side in the first direction when the first stoppers 18B collide with first collided parts 18A provided on both sides, in the second direction, of the second MP tray 12, respectively.

Further, second stoppers 18D are provided on both sides, in the second direction, of the second MP tray 12 to prevent the third tray 13 from further moving toward the advancing side in the first direction when the second stoppers 18D collide with second collided parts 18C provided on both side, in the second direction, of the third MP tray 13, respectively.

According to the first illustrative embodiment, the first collided parts 18A, the second collided parts 18C, the first stoppers 18B and the second stoppers 18D are provided on both sides, in the second direction, of the sheet tray 10. The first collided parts 18A are protrusions which are provided on both sides, in the second direction, of the second MP tray 12 and protrude outward in the second direction. The first stoppers 18B are protrusions provided on both sides, in the second direction, of the first MP tray 11 and protrude toward the second MP tray 12.

Similarly, the second collided parts 18C are protrusions provided on both sides, in the second direction, of the third MP tray 13 and protrude outward in the second direction. Further, the second stoppers 18D are protrusions provided on both sides, in the second direction, of the second MP tray 12 and protrude toward the MP tray 13.

Figure 9:
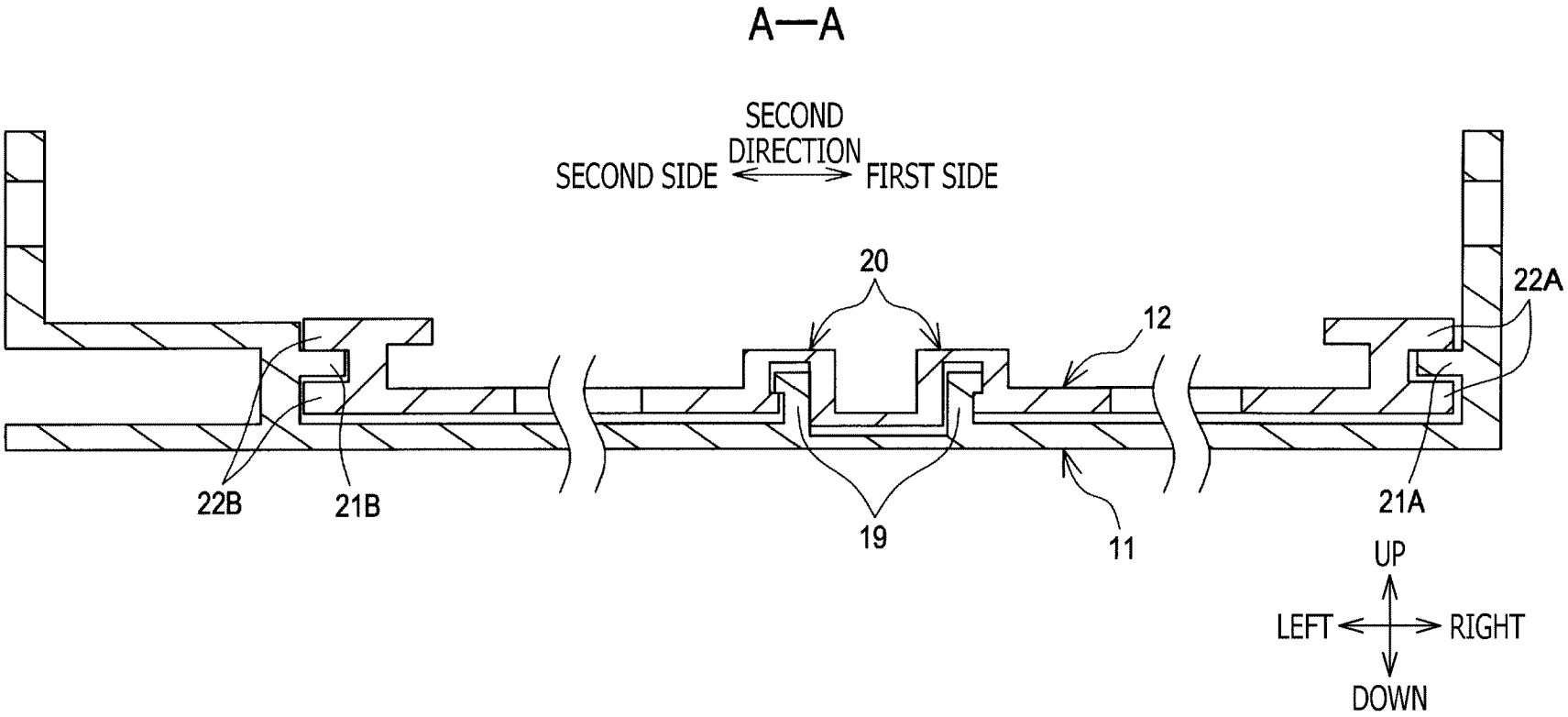
FIG. 9 is a cross sectional view of the first tray and a second tray taken along line A-A of FIG. 13 according to the first illustrative embodiment of the disclosures.

At a central portion, in the second direction, of the first MP tray 11, a first guiding part 19, which is configured to guide sliding movement of the second MP tray 12, is provided as shown in FIG. 9. According to the first embodiment, the first guiding part 19 has a first ridge 19A and a second ridge 19B as shown in FIG. 10.

Figure 10:
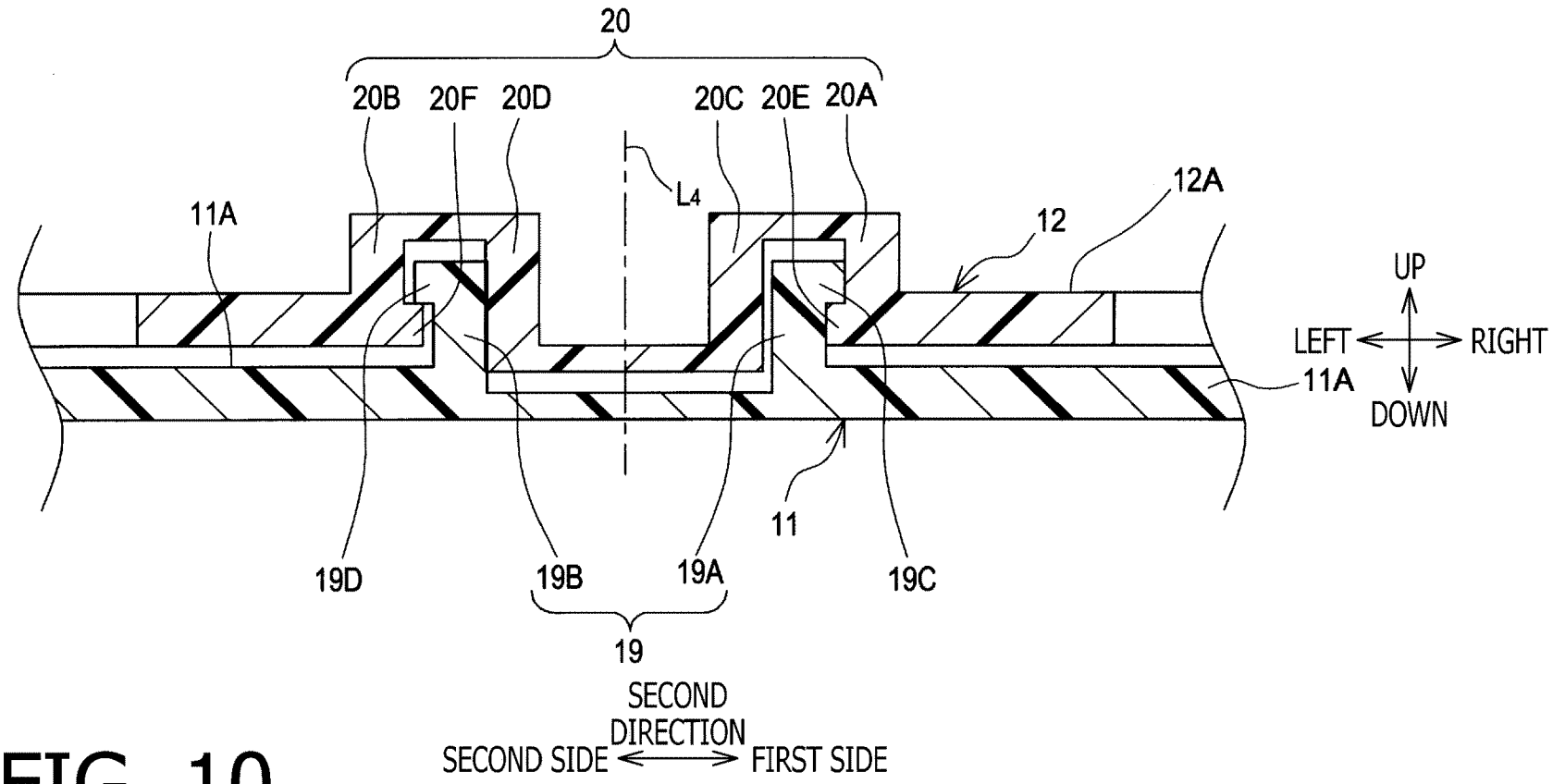
FIG. 10 is a partially enlarged view of FIG. 9.

The first ridge 19A and the second ridge 19B are spaced from each other and arranged at symmetrical positions with respect to the central line L4, in the second direction, on the first MP tray 11 (see FIG. 10). Each of the first ridge 19A and the second ridge 19B protrudes upward in the vertical direction from the first supporting surface 11A, and extends across substantially an entire length of the first MP tray 11 in the first direction (see FIG. 13).

At the central portion, in the second direction, of the second MP tray 12, a second guiding part 20, which is configured to slidably contact the first guiding portion 19 and guide the sliding movement of the second MP tray 12, is provided as shown in FIG. 9. According to the illustrative embodiment, the first guiding portion 19 protrudes upward from the first supporting surface 11A, and the second guiding portion 20 is formed to be upwardly recessed from the lower surface of the second MP tray 12 so as to receive the first guiding portion 19.

According to the first embodiment, the second guiding portion 20 has, as shown in FIG. 10, at least a first ridge 20A and a second ridge 20B. The first ridge 20A is configured to slidably contact the first ridge 19A from a first side in the second direction (i.e., from the right-hand side in FIG. 10). The second ridge 20B is configured to slidably contact the second ridge 19B from a second side (i.e., from the left-hand side in FIG. 10).

That is, the first guiding portion 19 (i.e., the first ridge 19A and the second ridge 19B) is sandwiched by the first ridge 20A and the second ridge 20B from both sides in the second direction. Therefore, shift of the second MP tray 12 in the second direction with respect to the first MP tray 11 is restricted.

First separation regulating parts 19C and 19D are formed on the first guiding portion 19, and second separation regulating parts 20E and 20F are formed on the second guiding portion 20 as shown in FIG. 10. Specifically, the first separation regulating part 19C is a ridge formed at an end portion of the first ridge 19A and protrudes toward the first side in the second direction. The first separation regulating part 19D is a ridge formed at an end portion of the second ridge 19B and protrudes toward the second side in the second direction.

Figure 13:
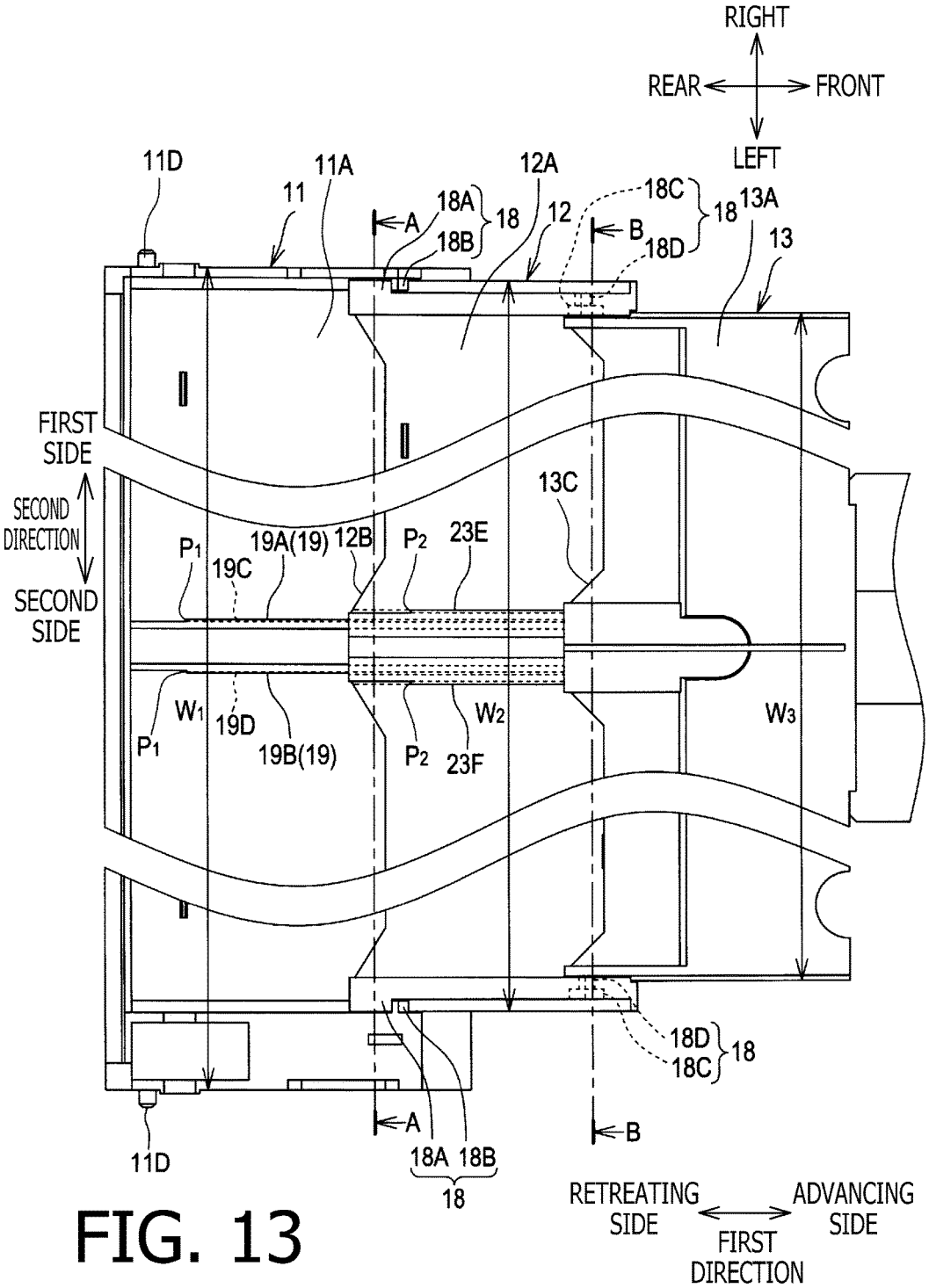
FIG. 13 is a plan view of the first tray, the second tray and a third tray according to the first illustrative embodiment of the disclosures.

Further, as shown in FIG. 13, the first separation regulating parts 19C and 19D are formed within a range from a position P1, which is a position spaced from the retreating end of the first guiding portion 19 in the first direction by a particular dimension, to an advancing side end of the first guiding portion 19.

The second separation regulating part 20E is, as shown in FIG. 10, a ridge, which is a part of the first ridge 20A and protrudes toward the first ridge 19A of the first guiding portion 19 at a position below the first separation regulating part 19C.

The second separation regulating part 20F is a ridge, which is a part of the ridge 20B and protrudes toward the second ridge 19B of the first guiding portion 19 at a position below the first separation regulating part 19D (see FIG. 10).

With the above-described configuration, the first separation regulating parts 19C and 19D slidably contact the second separation regulating parts 20E and 20F, respectively, thereby the second MP tray 12 being prevented from separating from the first MP tray 11 in the up-down direction exceeding a particular dimension. It is noted that the up-down direction is a direction perpendicular to the first supporting surface 11A.

Figure 14:
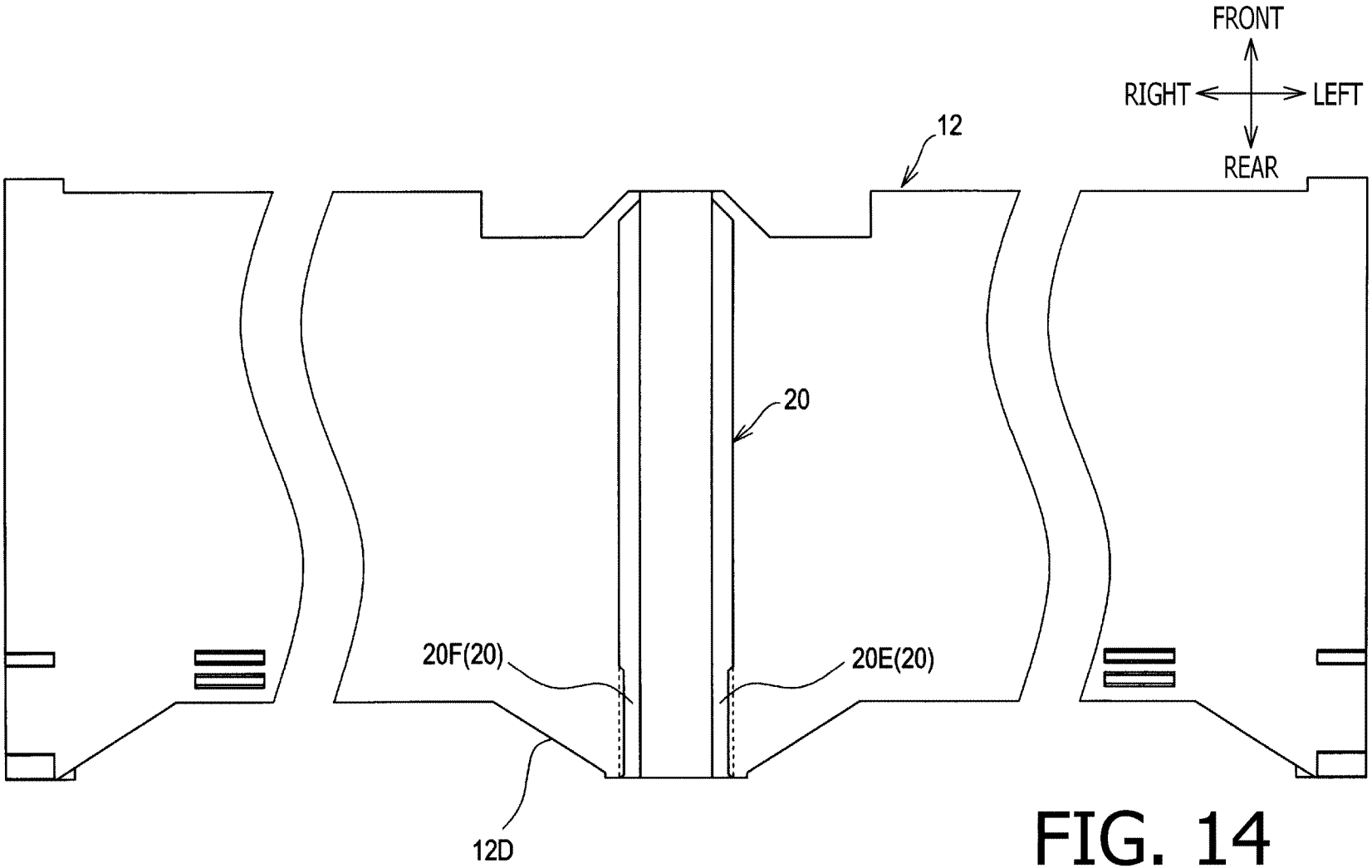
FIG. 14 shows a bottom surface of the second MP tray.

As shown in FIG. 14, the second separation regulating parts 20E and 20F and the first ridge 20A and the second ridge 20B of the second guiding portion 20 are arranged at least on the retreating side (i.e., on the rear side) in the first direction.

In particular, the second separation regulating parts 20E and 20F are arranged at least on a protruding part 12D. It is noted that the protruding part 12D is a central part, in the second direction, of the second MP tray 12, and protrudes toward the retreating side in the first direction.

According to the illustrative embodiment, the second guiding portion 20 has a third ridge 20C and a fourth ridge 20D, as shown in FIG. 10, in addition to the first ridge 20A and the second ridge 20B. The third ridge 20C is configured to slidably contact the first ridge 19A from the second side in the second direction (i.e., rightward in FIG. 10).

The fourth ridge 20D is configured to contact the second ridge 19B from the first side in the second direction (i.e., leftward in FIG. 10). The first through fourth ridges 20A-20D are formed on the second supporting surface 12A to protrude in a direction opposite to the first supporting surface 11A, and extend over an entire length, in the first direction, of the second MP tray 12.

According to the illustrative embodiment, as shown in FIG. 9, first end regulating parts 21A and 21B are provided at both sides, in the second direction, of the first MP tray 11, and second end regulating parts 22A and 22B are provided at both sides, in the second direction, of the second MP tray 12.

The first end regulating parts 21A and 22B, and the second end regulating parts 22A and 22B are configured to guide a sliding movement of the second MP tray 12 with respect to the first MP tray 11, while regulate a separation of the second MP tray 12 with respect to the first MP tray 11 exceeding a particular dimension in the up-down direction.

According to the illustrative embodiment, the first end regulating part 21A is a ridge formed at a first side end, in the second direction, of the first MP tray 11, and protruding toward the second side in the second direction, while the first regulating part 21B is a ridge formed at a second side end portion, in the second direction, of the first MP tray 11, and protruding toward the first side in the second direction.

The second end regulating part 22A has a pair of walls, which is provided at the first side end, in the second direction, of the second MP tray 12, and configured to sandwich the first end regulating part 21A in the up-down direction, and second end regulating part 22B has a pair of walls, which is provided at the second side end, in the second direction, of the second MP tray 12, and configured to sandwich the second end regulating part 21B in the up-down direction.

An assembling structure of the third MP tray 13 with respect to the second MP tray 12 is substantially the same, except for actual dimensions and shapes thereof, as the assembling structure of the second MP tray 12 with respect to the first MP tray 11 in terms of a technical aspect.

Figure 11:
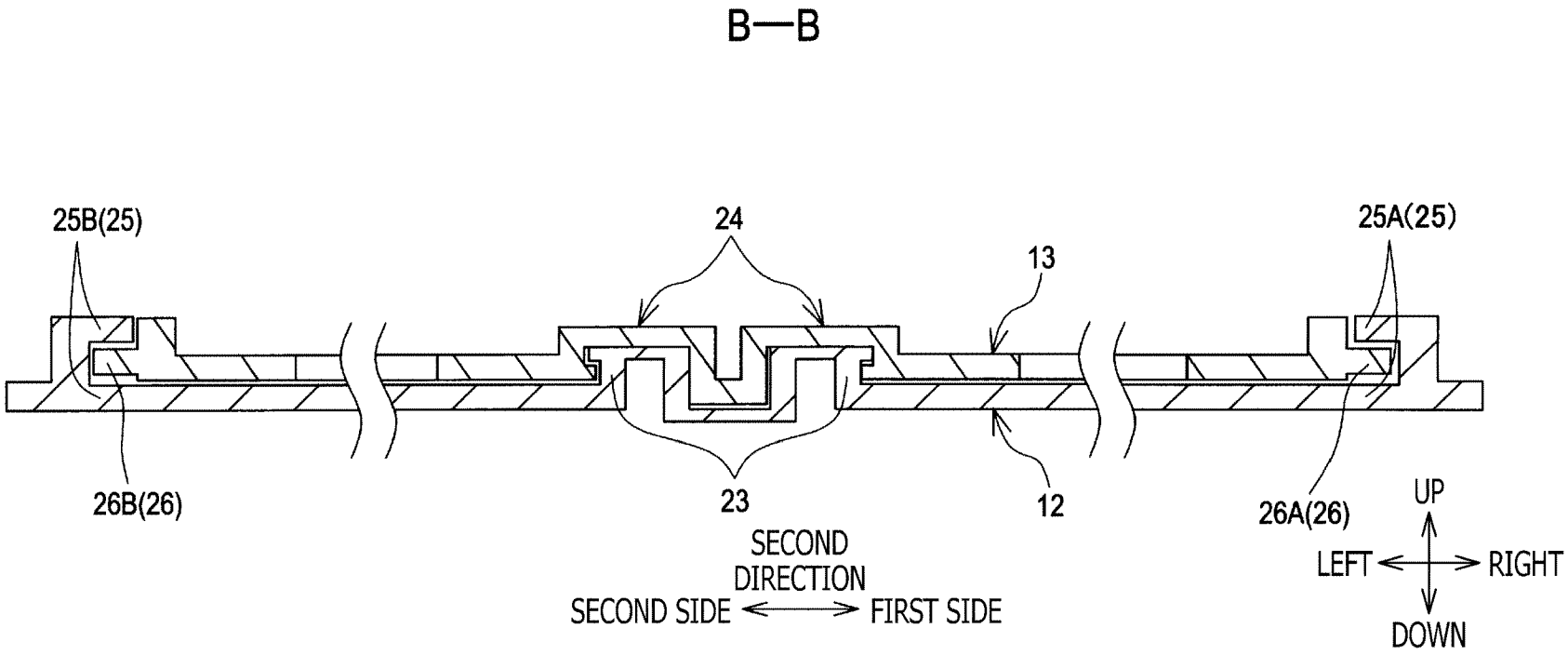
FIG. 11 is a cross sectional view of the first tray and the second tray taken along line B-B of FIG. 13 according to the first illustrative embodiment of the disclosures.
Figure 12:
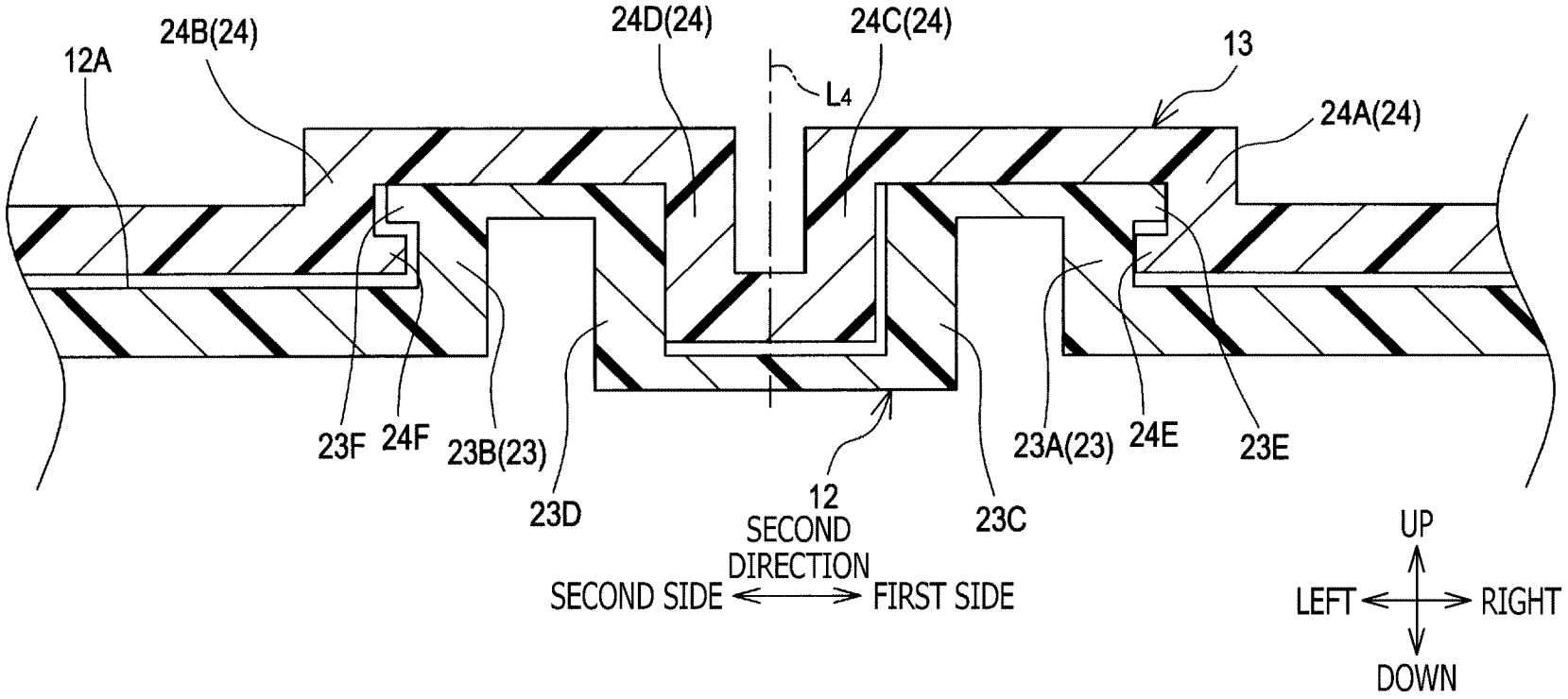
FIG. 12 is a partially enlarged view of FIG. 11.

As shown in FIG. 11, a third guiding portion 23 for guiding a slide movement of the third MP tray is formed at a central part, in the second direction, of the second MP tray 12. According to the illustrative embodiment, the third guiding portion 23 is configured to have a first ridge 23A and a second ridge 23B as shown in FIG. 12.

The first ridge 23A and the second ridge 23B are arranged to be spaced from each other and provided at a symmetrical positions with respect to the center line L4 of the second MP tray 12. The first ridge 23A and the second ridge 23B protrude upward, in the vertical direction, from the second supporting surface 12A, and extend over an entire dimension, in the first direction, of the second MP tray 12.

The first ridge 23A of the third guiding portion 23 is a belt-like protrusion extending in the first direction, which is formed continuously from the first ridge 20A of the second guiding portion 20. It is noted that the first ridge 23A of the third guiding portion 23 makes use of a first side surface (i.e., a right-hand side surface in FIG. 12) of the continuously formed ridge (20A and 23A), while the first ridge 20A of the second guiding portion 23 makes use of a second side surface (i.e., a left-hand side surface in FIG. 10) of the continuously formed ridge (20A and 23A).

The second ridge 23B of the third guiding portion 23 is also a belt-like protrusion extending in the first direction, which is formed continuously from the second ridge 20B of the second guiding portion 20. The second ridge 23B of the third guiding portion 23 makes use of a second side surface (i.e., a left-hand side surface in FIG. 12) of the continuously formed ridge (20A and 23A), while the second ridge 20B of the second guiding portion 23 makes use of a first side surface (i.e., a right-hand side surface in FIG. 10) of the continuously formed ridge (20A and 23A).

The third ridge 23C of the third guiding portion 23 is also a belt-like protrusion extending in the first direction, which is formed continuously from the third ridge 20C of the second guiding portion 20. Similarly, the fourth ridge 23D of the third guiding portion 23 is a belt-like protrusion extending in the first direction, which is formed continuously from the fourth ridge 20D of the second guiding portion 20.

At a central part, in the second direction, of the third MP tray 13, a fourth guiding portion 24 is provided. The fourth guiding portion 24 is configured to slidably contact the third guiding portion 23 to guide sliding movement of the third MP tray 13. The third guiding portion 23 is protruded upward, in the vertical direction, on the second supporting surface 12A, and the fourth guiding portion 24 is recessed upward, in the vertical direction, from a lower surface of the third MP tray 13.

The fourth guiding portion 24 according to the illustrative embodiment has, as shown in FIG. 12, at least a first ridge 24A and a second ridge 24B. The first ridge 24A of the fourth guiding portion 24 is configured to slidably contact the first ridge 23A of the third guiding portion 23 from the first side (i.e., from the right-hand side of FIG. 12).

The second ridge 23B of the fourth guiding portion 24 is configured to slidably contact the second ridge 23B of the third guiding portion 23 from the second side (i.e., the left-hand side of FIG. 12). Thus, the first ridge 23A and the second ridge 23B of the third guiding portion 23 is sandwiched by the first ridge 24A and the second ridge 23B of the fourth guiding portion 24.

With this configuration, the third MP tray 13 is prevented from being displaced in the second direction with respect to the second MP tray 12. It is noted that each of the third guiding portion 23 and the fourth guiding portion 24 is shaped and arranged symmetrically with respect to the above-described virtual bisector Lv.

The center O1 of rotation of the first rotatable tray 14A and the center O2 of rotation of the second rotatable tray 14B are arranged in a central portion, in the second direction, at symmetrical positions, in the second direction, with respect to the virtual bisector Lv. Thus, the third guiding portion 23 and the fourth guiding portion 24 are located between the center O1 of rotation of the first rotatable tray 14A and the center O2 of rotation of the second rotatable tray 14B (see FIGS. 3 and 4).

First separation regulating parts 23E and 23F are formed on the third guiding portion 23, and second separation regulating parts 24E and 24F are formed on the fourth guiding portion 24 as shown in FIG. 12. Specifically, the first separation regulating part 23E is a ridge formed at an end portion of the first ridge 23A and protrudes toward the first side in the second direction. The first separation regulating part 23F is a ridge formed at an end portion of the second ridge 23B and protrudes toward the second side in the second direction (i.e., in the right-hand side in FIG. 12).

Further, as shown in FIG. 13, the first separation regulating parts 23E and 23F are formed within a range from a position P2, which is a position shifted from the retreating end of the third guiding portion 23 in the advancing side (in the first direction) by a particular dimension, to the advancing side end, in the first direction, of the third guiding portion 23.

The second separation regulating part 24E is, as shown in FIG. 12, a ridge, which is a part of the first ridge 24A and protrudes toward the first ridge 23A of the third guiding portion 23 at a position below the first separation regulating part 23E.

The second separation regulating part 24F is a ridge, which is a part of the ridge 24B of the fourth guiding portion 24 and protrudes toward the second ridge 23B of the third guiding portion 23 at a position below the first separation regulating part 23F (see FIG. 12).

With the above-described configuration, the first separation regulating parts 23E and 23F slidably contact the second separation regulating parts 24E and 24F, respectively, thereby the third MP tray 13 being prevented from separating from the second MP tray 12 in the up-down direction exceeding a particular dimension.

It is noted that, the second separation regulating parts 24E and 24F, and the first ridge 24A and the second ridge 24B of the fourth guiding part 24 are formed at least on the retreating side in the first direction. In particular, the second separation regulating parts 24E and 24F are provided at least on the protruding part 13C. The protruding part 13C is, as shown in FIG. 13, a central portion in the second direction, and a retreating side portion in the first direction of the third MP tray 13, and formed to protrude toward the retreating side in the first direction.

The fourth guiding part 24 according to the illustrative embodiment has, as shown in FIG. 12, a third ride 24C and a fourth ridge 24D in addition to the first ridge 24A and the second ridge 24B as shown in FIG. 12. The third ridge 24C is configured to slidably contact the third ridge 23C of the third guiding portion 23 from the second side in the second direction (i.e., from the left-hand side in FIG. 12).

The fourth ridge 24D is configured to slidably contact the fourth ridge 23D of the third guiding portion 23 from the first side in the second direction (i.e., from the right-hand side in FIG. 12). The first-fourth ridges 24A-24D are formed to protrude toward the supporting surface 11A on the back surface of the second supporting surface 12A, and extend over an entire dimension, in the first direction, of the third MP tray 13.

According to the illustrative embodiment, as shown in FIG. 11, first end regulating parts 25A and 25B are provided at both sides, in the second direction, of the second MP tray 12, and second end regulating parts 26A and 26B are provided at both sides, in the second direction, of the third MP tray 13.

The first end regulating parts 25A and 25B, and the second end regulating parts 26A and 26B are configured to guide a sliding movement of the third MP tray 13 with respect to the second MP tray 12, while regulate a separation of the third MP tray 13 with respect to the second MP tray 12 exceeding a particular dimension in the up-down direction.

According to the illustrative embodiment, the second regulating part 26A is a ridge formed at a first side end, in the second direction, of the third MP tray 13, and protruding outward (i.e., toward the second side in the second direction), while the second regulating part 26B is a ridge formed at a second side end, in the second direction, of the third MP tray 13, and protruding outward (i.e., toward the first side in the second direction).

The first end regulating part 25A has a pair of walls, which is provided at the first side end, in the second direction, of the second MP tray 12, and configured to sandwich the second end regulating part 26A in the up-down direction, and first end regulating part 25B has a pair of walls, which is provided at the second side end, in the second direction, of the second MP tray 12, and configured to sandwich the second end regulating part 26B in the up-down direction.

2.5 Movement Controlling Mechanism for Sheet Tray

When the grip 15 of the sheet tray 10 in an accommodated state is pulled by a user toward the advancing side in the first direction, in association with the movement of the grip 15, the second MP tray 12 and the third MP tray 13 slide toward the advancing side in the first direction, and the rotatable trays 14 rotate to the supporting position, thereby the sheet tray 10 being in the usage state.

When the grip 15 of the sheet tray 10 in the usage state is pushed by the user toward the retreating side in the first direction, in association with the movement of the grip 15, the second MP tray 12 and the third MP tray 13 slide toward the retreating side in the first direction, and the rotatable trays 14 rotate to the accommodated position, thereby the sheet tray 10 being in the accommodated state.

Figure 15:
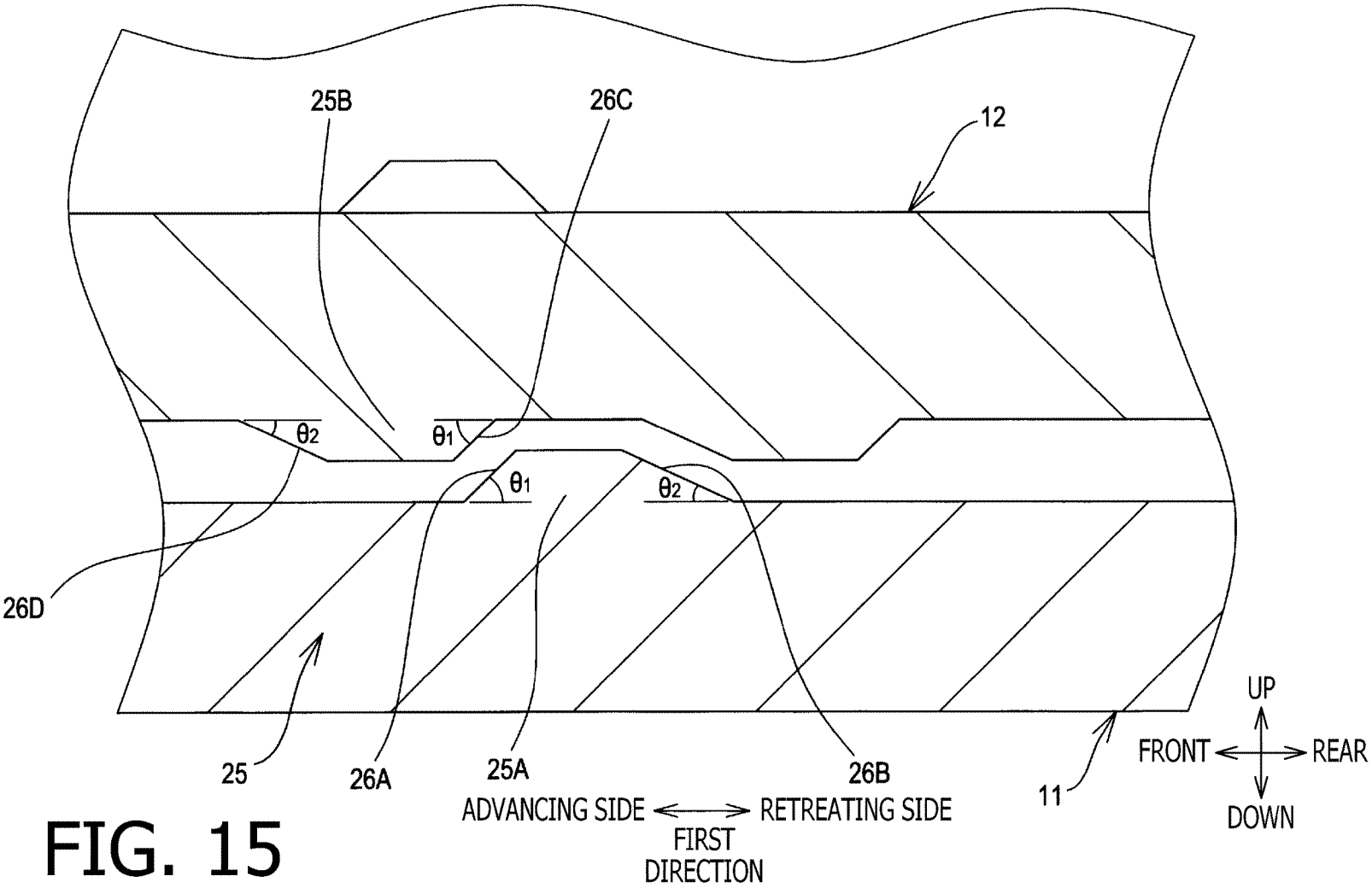
FIG. 15 is an enlarged view of a movement control mechanism for the first MP tray and the second MP tray according to the first illustrative embodiment.
Figure 16:
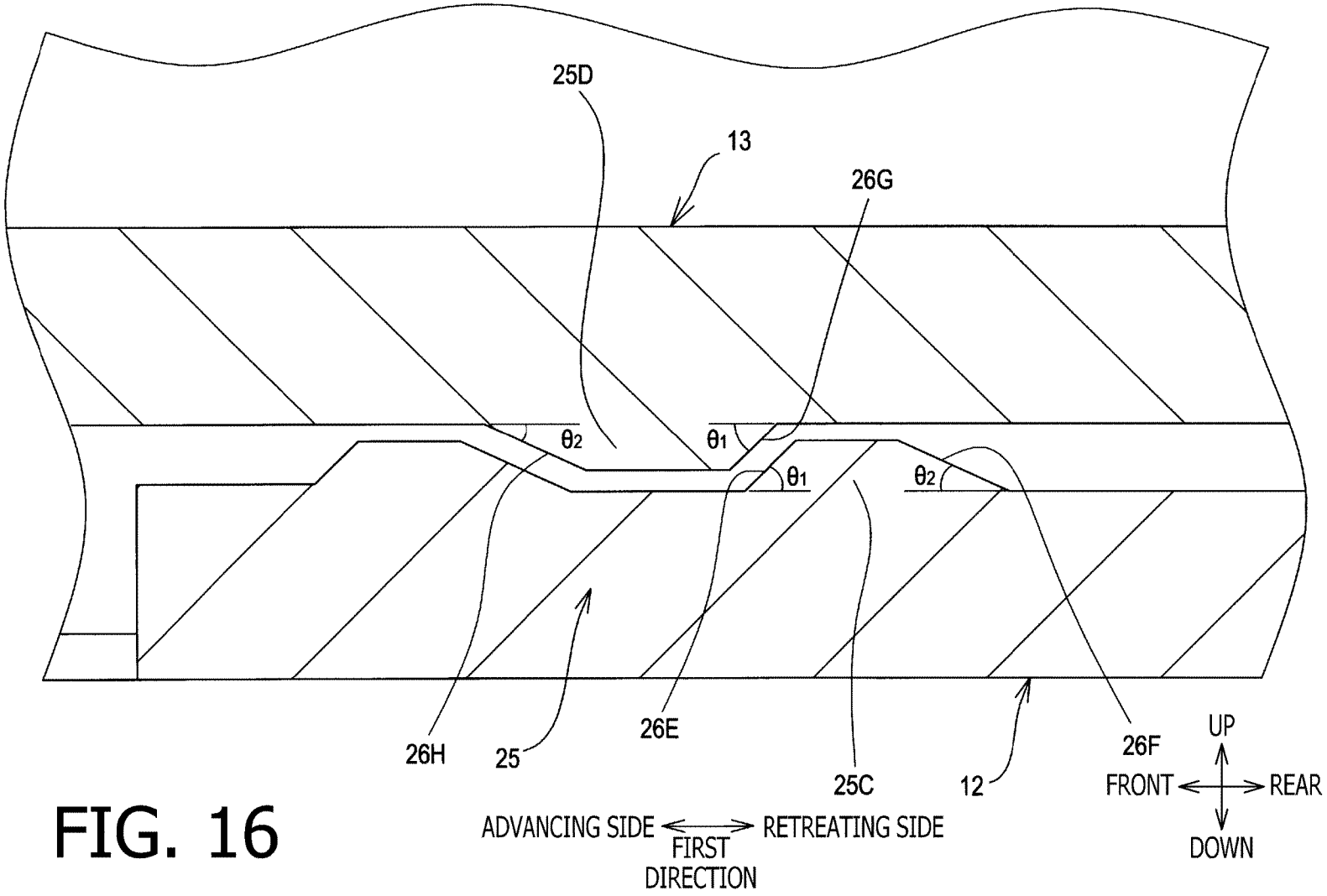
FIG. 16 is an enlarged view of the movement control mechanism for the second MP tray and the third MP tray according to the first illustrative embodiment.
Figure 17:
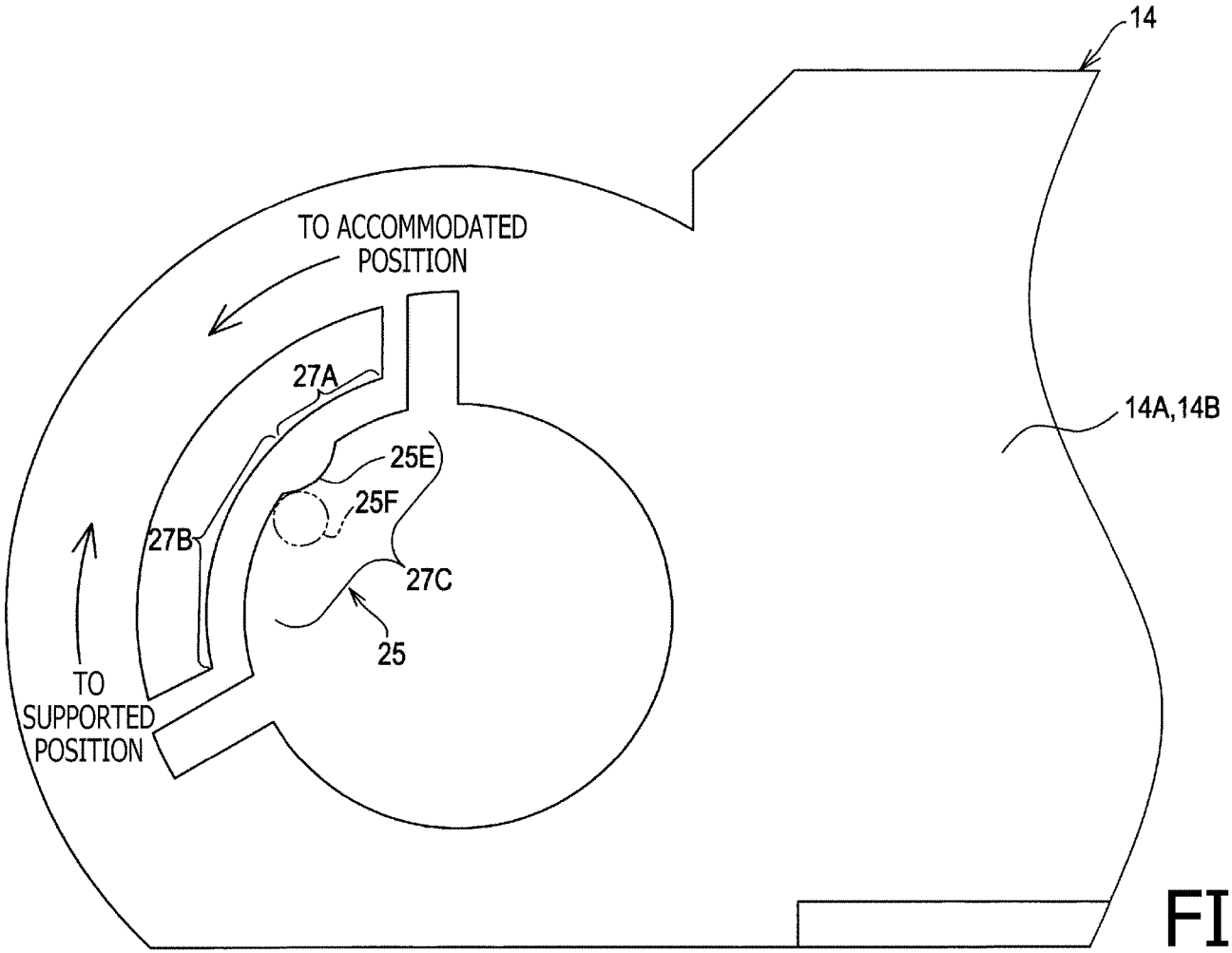
FIG. 17 is an enlarged view of the movement control mechanism for the rotatable trays according to the first illustrative embodiment.

According to the first illustrative embodiment, the sheet tray 10 has a movement control mechanism 25, which is shown in FIGS. 15-17. The movement control mechanism 25 mechanically controls a sliding movement of the second MP tray 12 and the third MP tray 13, and a rotating movement of the rotatable trays 14 when the sheet tray 10 is expanded (i.e., the state of the sheet tray 10 changes from the accommodated state to the usage state, or when the sheet tray 10 is retracted (i.e., the state of the sheet tray 10 changes from the usage state to the accommodated state).

That is, when the sheet tray 10 is expanded, the movement control mechanism 25 functions to make frictional resistance (hereinafter, also referred to as sliding resistance) between the first MP tray 11 and the second MP tray 12, and frictional resistance or the sliding resistance between the second MP tray 12 and the third MP tray 13, be smaller than frictional resistance (hereinafter, also referred to as rotation resistance) between the third MP tray 13 and the rotatable tray 14.

Further, when the sheet tray 10 is retracted, the movement control mechanism 25 functions to make the sliding resistance greater than the rotation resistance. Accordingly, when the sheet tray 10 is expanded, the rotatable trays 14 rotate to the supporting position after the second MP tray 12 and the third MP tray 13 are moved to the advancing side in the first direction.

When the sheet tray 10 is retracted, the second MP tray 12 and the third MP tray 13 slidably shift toward the retreating side in the first direction after the rotatable trays 14 are rotated to the accommodated position.

The movement control mechanism 25 has, as shown in FIGS. 15-17, a first protrusion 25A, a second protrusion 25B, a third protrusion 25C and a fourth protrusion 25D which are configured to generate the sliding resistances between the first and second MP trays 11 and 12, and between the second and third MP trays 12 and 13, and a fifth protrusion 25E and a sixth protrusion 25F which are configured to generate the rotation resistance between the rotatable trays 14 and the third MP tray 13.

As shown in FIG. 15, the first protrusion 25A is provided to the first MP tray 11. The second protrusion 25B is provided to the second MP tray 12 at a portion facing the first protrusion 25A. The first protrusion 25A and the second protrusion 25B are configured to slidably contact each other.

Each of the first protrusion 25A and the second protrusion 25B are configured such that both end surfaces in the first direction are inclined with respect to the first direction. In particular, an inclination angle θ1 of an end surface 26A, which is the advancing side end surface, of the first protrusion 25A is greater than an inclination angle θ2 of an end surface 26B, which is the retreating side end surface, of the first protrusion 25A. It is noted that the inclination angle θ1 or θ2 represents an angle of a surface with respect to the first direction.

Further, an inclination angle θ1 of an end surface 26C, which is the retreating side end surface, of the second protrusion 25B is greater than an inclination angle θ2 of an end surface 26D, which is the advancing side end surface, of the second protrusion 25B. With the above configuration, the slide resistance generated between the second MP tray 12 and the first MP tray 11 when the second MP tray 12 slides, with respect to the first MP tray 11, toward the advancing side in the first direction is smaller than the slide resistance when the second MP tray 12 slides, with respect to the first MP tray 11, toward the retreating side in the first direction.

As shown in FIG. 16, the third protrusion 25C is provided to the second MP tray 12. The fourth protrusion 25D is provided to the third MP tray 13 at a portion facing the third protrusion 25C. The third protrusion 25C and the fourth protrusion 25D are configured to slidably contact each other.

Each of the third protrusion 25C and the fourth protrusion 25D are configured such that both end surfaces in the first direction are inclined with respect to the first direction. In particular, an inclination angle θ1 of an end surface 26EA, which is the advancing side end surface, of the third protrusion 25C is greater than an inclination angle θ2 of an end surface 26F, which is the retreating side end surface, of the third protrusion 25C. It is noted that the inclination angle θ1 or θ2 represents an angle of a surface with respect to the first direction.

Further, an inclination angle θ1 of an end surface 26G, which is the retreating side end surface, of the fourth protrusion 25D is greater than an inclination angle θ2 of an end surface 26H, which is the advancing side end surface, of the fourth protrusion 25D. With the above configuration, the slide resistance generated between the third MP tray 13 and the second MP tray 12 when the third MP tray 13 slides, with respect to the second MP tray 12, toward the advancing side in the first direction is smaller than the slide resistance when the third MP tray 13 slides, with respect to the second MP tray 12, toward the retreating side in the first direction.

As shown in FIG. 17, the fifth protrusion 25E is provided to each of the rotatable trays 14. The sixth protrusions 25F are provided to the third MP tray 13. The fifth protrusion 25E and the sixth protrusion 25F are configured to slidably contact each other. The fifth protrusion 25E is provided at an end portion of a first friction arm 27A and at an end portion of a second arm 27B.

It is noted that the first friction arm 27A and the second friction arm 27B are connected to each other at end portions thereof. That is, the first friction arm 27A and the second friction arm 27B constitute an arc-shaped arm 27C. Further, the fifth protrusion 25E is formed at a portion where the first friction arm 27A and the second friction arm 27B are connected (i.e., at the end portions of the first friction arm 27A and the second friction arm 27B).

It is noted that the length of the first friction arm 27A is shorter than the length of the second friction arm 27B. Therefore, the fifth protrusion 25E is formed at a position displaced from a longitudinal center of the arm 27C. Further, the sixth protrusion 25F contacts the fifth protrusion 25E from the first friction arm 27A side when the rotatable trays 14 are expanded.

When the sheet tray 10 is retracted, the sixth protrusion 25F contacts the fifth protrusion 25E from the second friction arm 27B side. It is noted that the fifth protrusion 25E is more difficult to be displaced as the length of the arm is shorter. Therefore, the rotation resistance when the rotatable trays 14 are expanded is greater than the rotation resistance when the rotatable trays 14 are retracted.

The inclination angle θ2 of each of the surfaces 26B, 26D, 26F and 26H, the length of the first friction arm 27A, and the shape of the length of the fifth protrusion 25R are determined such that the rotatable trays 14 rotate towards the supporting position after the second MP tray 12 and the third MP tray 13 slidably move toward the advancing side in the first direction when the sheet tray 10 is expanded.

Further, the inclination angles θ1 of each of the surfaces 26A, 26C, 26E and 26G, the length of the second friction arm 27B, and the shape of the fifth protrusion 25E are determined such that the second MP tray 12 and the third MP tray 13 slidably move toward the retreating side in the first direction after the rotatable trays 14 rotate toward the accommodated positions when the sheet tray 10 is retracted.

3. Characteristic Features of Sheet Tray According to the Embodiment

The rotatable trays 14 are assembled to an advancing side end of the third MP tray 14 at a portion on the second supporting surface 12A side with respect the first supporting surface 11A. With the above configuration, the rotatable trays 14 will not move to the first MP tray 11 or the second MP tray 14, and does not touch the same. Therefore, the rotatable trays 14 never contact the first MP tray 11 or the second MP tray 12. Accordingly, interference of movement of the third MP tray 14 and the rotatable tray 14 can be suppressed.

On the advancing side end, in the first direction, of the third MP tray 13, that is, on the front end 13B of the third MP tray 13, the enclosure 16 configured to accommodate the rotatable trays 14 is formed. With this structure, it is ensured that interference of movement of the third MP tray 13 and the rotatable trays 14 can be suppressed.

On the third supporting surface 13A side of the third MP tray 13, first through openings 16A, each of which communicates with the inside of the enclosure 16 and is formed to be U-shaped such that the advancing side thereof is opened, are formed. As these through openings 16A are formed, the user can easily touch the rotatable trays 14 in the accommodated state and bring the rotatable trays 14 to be in the supporting state.

On the opposite side of the supporting surface 13A, that is, on the lower surface, in the vertical direction, of the third MP tray 13, second through openings 16B, each of which communicates with the inside of the enclosure 16 and is formed to be U-shaped such that the advancing side thereof is opened, are formed (see FIG. 6).

As these through openings 16B are formed, the user can easily touch the rotatable trays 14 in the accommodated state and bring the rotatable trays 14 to be in the supporting state. Further, since the first through openings 16A and the second through openings 16B are arranged at opposite positions in the up-down direction, which allows the user to change the state of the rotatable trays 14 from the accommodated state to the supporting state easily.

The sliding parts 12B and 12C are configured to convert contacting forces generated at positions where the sliding parts 12B and 12C contact the sliding contact parts 14E and 14F to retracting moments which cause the rotatable trays 14 in the supporting state to rotate so as to bring the same into the accommodated state. With this configuration, the rotatable trays 14 can automatically be brought into the accommodated state.

Further, the sheet tray 10 is provided with the link mechanism 17 which converts the force directed toward the advancing side and applied to the grip 15 to a force which causes to the rotatable trays 14 to be directed to the supporting position. With this configuration, as the grip 15 is slid toward the advancing side by the user, the second MP tray 12, the third MP tray 13 and the rotatable tray 14 are moved in mechanical association with each other.

Accordingly, the user can make the second MP tray 12 and the third MP tray 13 slidably move with respect to the first MP tray 11 and further make the rotatable trays 14 move from the accommodated position side to the supporting position side only by one operation.

According to the illustrative embodiment, the third guiding portion 23 and the fourth guiding portion 24 are provided between the center of rotation O1 of the first rotatable tray 14A and the center of rotation O2 of the second rotatable tray 14B. With this configuration, in comparison with a case where the third guiding portion 23 and the fourth guiding portion 24 are provide on the end side in the second direction, the third MP tray 13 slides smoothly.

A longitudinal dimension W4 of the grip 15 is greater than a dimension W3, in the second direction, of the third MP tray 13. According to such a configuration, at least a parting line which is formed on the third MP tray 13 which is formed of resin by molding can be concealed with grip 15. Thus, such a configuration is advantageous in view of appearance design.

There is provided the movement control mechanism 25 which is configured to mechanically control the sliding movement of the second MP tray 12 and the third MP tray 13, and the rotating movement of the rotatable trays 14 when the sheet tray 10 is expanded and retracted.

According to the above configuration, when the sheet tray 10 is expanded, the second MP tray 12 and the third MP tray 13 start sliding toward the advancing side in the first direction, and thereafter the rotatable trays 14 start rotating toward the supporting position.

When the sheet tray 10 is retracted, after the rotatable trays 14 start rotating toward the accommodated position, the second MP tray 12 and the third MP tray 13 start sliding toward the retreating side in the first direction. Therefore, an expansion property and a retraction property of the sheet tray 10 are improved according to the above-described configuration.

To the first guiding portion 19 and the third guiding portion 23, the first separation regulating parts 19C, 19D, and 23E, 23F are provided, respectively, and to the second guiding portion 20 and the fourth guiding portion 24, the second separation regulating parts 20E, 20F and 24E, 24F are provided, respectively.

According to the above configuration, a relatively large amount of separation of the center, in the second direction, of the second MP tray 12 with respect to the center, in the second direction, of the first MP tray 11 is suppressed, and a relatively large amount of separation of the center, in the second direction, of the third MP tray 13 with respect to the center, in the second direction, of the second MP tray 12 is also suppressed, by the first separation regulating parts 19C, 19D, 23E, 23F and the second separation regulating parts 20E, 20F, 24E and 24F.

Therefore, generation of a relatively large clearance between the center, in the second direction, of the first MP tray 11 and the center, in the second direction, of the second MP tray 12, and generation of a relatively large clearance between the center, in the second direction, of the second MP tray 12 and the center, in the second direction, of the third MP tray 13, can be suppressed.

The sheet tray 10 has the first end regulating parts 21A, 21B, 25A and 25B, and the second regulating parts 22A, 22B, 26A and 26B. Because of this configuration, a relatively large amount of sagging-down of both ends, in the second direction, of the second MP tray 12 and the third MP tray 13 can be suppressed.

According to the embodiment, the first guiding portion 19 extends over an entire dimension, in the first direction, of the first MP tray 11, each of the second guiding portion 20 and the third guiding portion 23 extends over an entire dimension, in the first direction, of the second MP tray 12, and the fourth guiding portion 24 extends over an entire dimension, in the first direction, of the third MP tray 13. With this configuration, the flexural rigidity of each of the trays 11, 12 and 13 is improved.

A dimension W3, in the second direction, of the third MP tray 13 is smaller than a dimension W2, in the second direction, of the second MP tray 12, and the dimension W2 of the second MP tray 12 is smaller than a dimension W1, in the second direction, of the first MP tray 11.

Therefore, the tray arranged on the advancing side in the first direction can be configured to have smaller mass in comparison with the tray arranged on the retreating side.

Therefore, the advancing side portion of the sheet tray 10 is suppressed from largely hanging down when expanded.

<Second Illustrative Embodiment>

Figure 18:
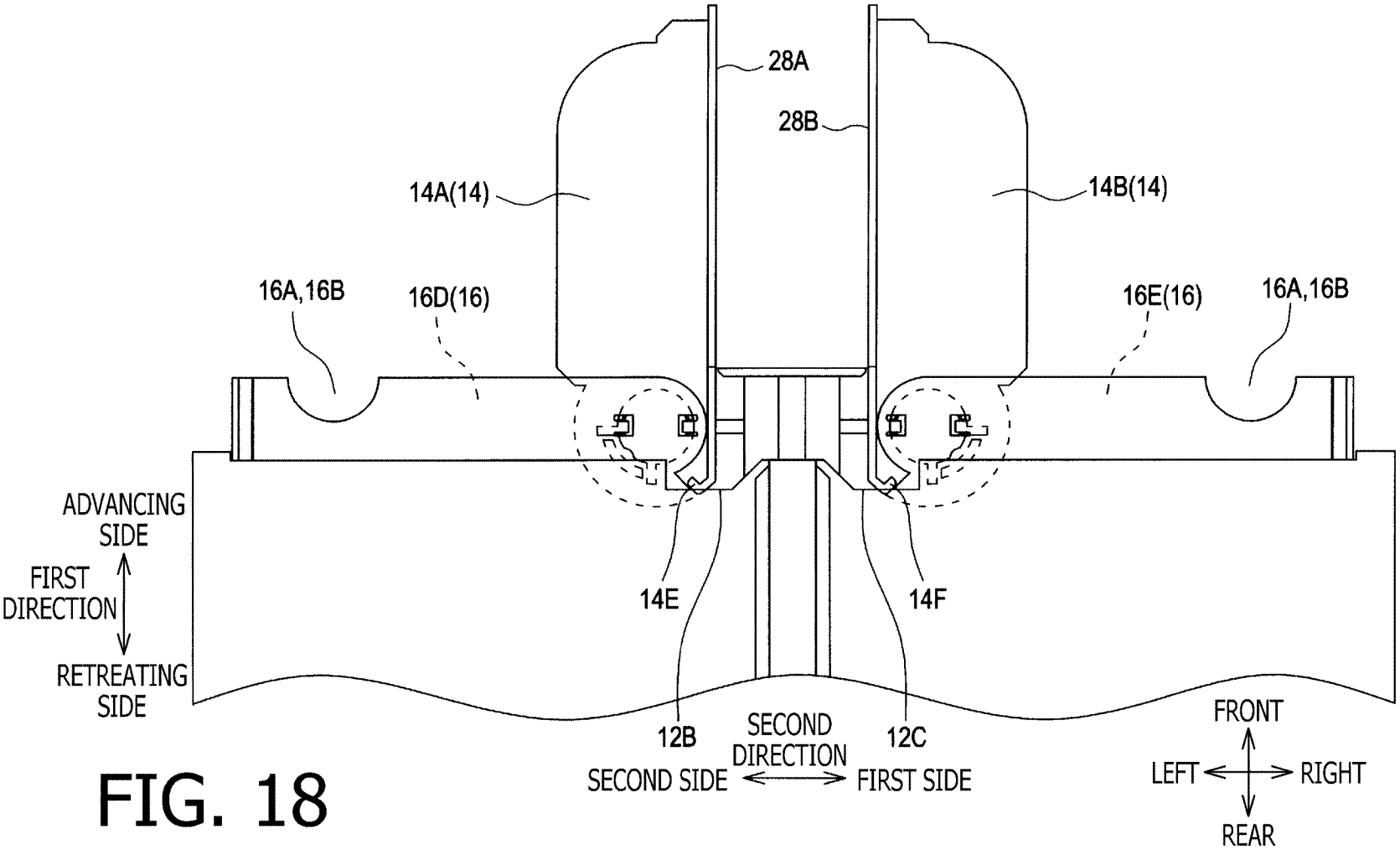
FIG. 18 shows an end portion of a sheet tray according to a second illustrative embodiment.

The rotatable trays 14 according to a second illustrative embodiment are shown in FIG. 18. As shown in FIG. 18, the rotatable trays 14 are respectively provided with front walls 28A and 28B for covering advancing side of the enclosure 16. Each of the front walls 28A and 28B is formed to have a belt-like shape and provided to portions of the rotatable trays 14 which protrude from the enclosure 16 when the rotatable trays 14 are located at the accommodated positions.

Figure 19:
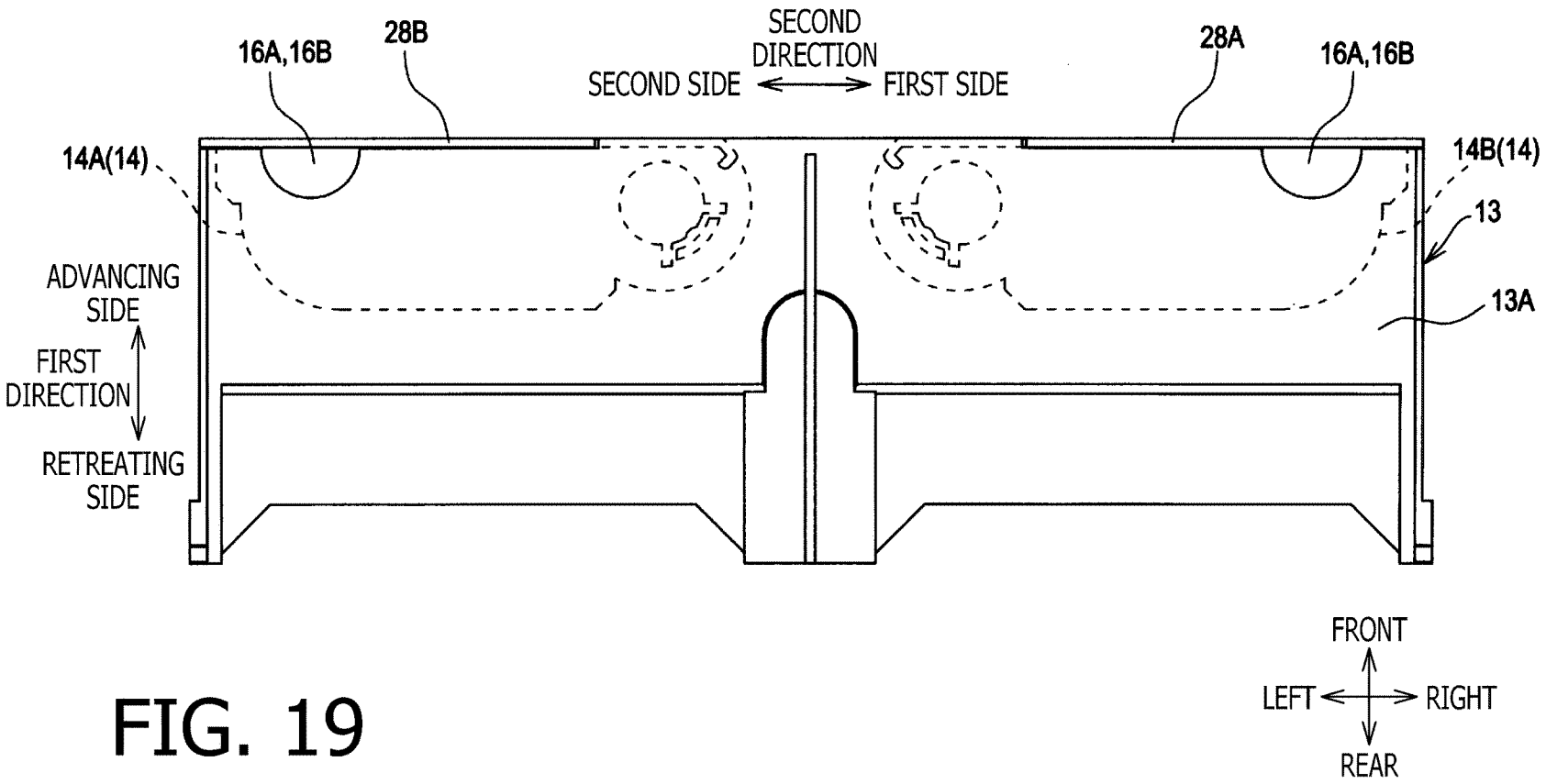
FIG. 19 shows the end portion of the sheet tray according to the second illustrative embodiment.

With the above configuration, an entrance of the enclosure 16 (i.e., an opening of the enclosure 16 on the advancing side thereof) can be covered with the front walls 28A and 28B, thereby an appearance design of the enclosure 16 can be improved. It is noted that, in FIGS. 18 and 19, components and structures which are similar to those in the first illustrative embodiment are assigned with the same reference numerals and redundant description will be omitted for brevity.

<Other Embodiments>

In the above-described embodiments, the sheet tray 10 is used as a multi-purpose sheet feed tray of the image forming apparatus 1. It is noted that application of the sheet tray 10 need not be limited to the above-described one. That is, the sheet tray 10 as described above can be applied as a sheet discharge tray of the image forming apparatus and/or an original tray for a facsimile apparatus or an image scanning apparatus.

According to the above-described embodiments, the sheet tray 10 includes two slidable trays (i.e., the second MP tray 12 and the third MP tray 13). It is noted that the number of the slidable trays needs not be limited to "two." That is, the sheet tray may include only one slidable tray, or more than two slidable trays.

The link mechanism 17 according to the above-described embodiments is configured such that the first link member 17A and the second link member 17B become closer to a parallel state as the sheet trays 14 are located at portions closer to the supporting positions. It is noted that the above-structure is only an example and the first link member 17A and the second link member 18B may be configured to intersect with each other.

According to the above-described illustrative embodiment, the sheet tray 10 is provided with the enclosure 16. It is noted that the configuration of the sheet tray 10 need not be limited to have the enclosure 16. For example, the enclosure 16 may be omitted, and the rotatable trays 14 may be configured to be accommodated on an upper side of the third supporting surface 13A.

According to the second illustrative embodiment, the sheet tray 10 is provided with the grip 10 and the front walls 28A and 28B. The configuration may be modified such that at least the grip 15 or the front walls 28A and 28B may be omitted.

According to the above-described embodiments, the first through opening 16A and the second through opening 16B are formed on the front end portion 13B of the third MP tray 13, or at the entrance of the enclosure 16. This configuration is only an example, and can be modified in various ways.

For example, one of the first through opening 16A and the second through opening 16B may be omitted. For another example, the first and second through openings 16A and 16B may be formed at portions other than the front end portion 13B of the third MP tray 13.

In the above-described embodiments, the force applied to the grip 15 by the user is converted to the retracting moment, which causes the rotatable trays 14 to rotate from the supporting positions to the accommodated positions with use of the slidable parts 12B and 12C, and the sliding contact parts 14E and 14F as a converting mechanism.

The above-described converting mechanism may not be intended to limit the structure of the sheet tray 10. For example, such a converting mechanism may be omitted. Alternatively, such a converting mechanism may be configured with use of a structure such as a link mechanism instead of the slidable parts 12B and 12C, and the sliding contact parts 14E and 14F.

According to the illustrative embodiments, the rotatable trays 14 include a first rotatable tray 14A and a second rotatable tray 14B. The structure of the sheet tray 10 should not be limited to those of the embodiments. Rather, the structure could be modified in various ways. For example, the rotatable trays 14A and 14B may be configured as a single rotatable tray 14.

According to the above-described embodiments, the dimension W3, in the second direction, of the third MP tray 13 is smaller than the dimension W2, in the second direction, of the second MP tray 12, and the dimension W2 of the second MP tray 12 is smaller than the dimension W1, in the second direction, of the first MP tray 11. However, the sheet tray 10 should not be limited to the above configuration.

In the above-described embodiment, the movement control mechanism 25 making use of the frictional resistance is provided. It is noted that the sheet tray 10 need not be limited to such a configuration. For example, the movement control mechanism 25 may be omitted. Alternatively, the movement control mechanism may be configured without using the frictional resistance (e.g., by employing a link mechanism or the like).

According to the above-described embodiments, to the first guiding portion 19 and the third guiding portion 23, the first separation regulating parts 19C, 19D, and 23E, 23F are provided, respectively, and to the second guiding portion 20 and the fourth guiding portion 24, the second separation regulating parts 20E, 20F and 24E, 24F are provided, respectively. It is noted that the sheet tray 10 needs not be limited to such a configuration, and the separation regulating parts 19C, 19D, 23E, 23F, 20E, 20F, 24E and 24F may be omitted.

According to the above-described embodiments, the sheet tray 10 has the first end regulating parts 21A, 21B, 25A and 25B, and the second regulating parts 22A, 22B, 26A and 26B. It is noted that the sheet tray 10 needs not be limited to such a configuration, and these end regulating parts 21A, 21B, 25A, 25B, 22A, 22B, 26A and 26B may be omitted.

According to the embodiment, the first guiding portion 19 extends over an entire dimension, in the first direction, of the first MP tray 11, each of the second guiding portion 20 and the third guiding portion 23 extends over an entire dimension, in the first direction, of the second MP tray 12, and the fourth guiding portion 24 extends over an entire dimension, in the first direction, of the third MP tray 13. It is noted that the sheet tray 10 needs not be limited to this configuration.

It is noted that the above-described embodiments and modifications are only examples of what is set forth in the claims, and are not intended to limit the scope of the claims. It is noted that the scope of the claims may include appropriate combination(s) of elements of at least two of the embodiments and modifications.

What is claimed is:

1. A sheet tray, comprising:

an image forming device configured to form an image on a sheet;

a main body configured to accommodate the image forming device therein;

a sheet feeder configured to feed the sheet from a sheet feed port formed on the main body toward the image forming device;

a first tray assembled to the main body such that the sheet tray is rotatable between a closed position at which the sheet tray covers the sheet feed port and an opened position at which the sheet tray uncovers the sheet feed port, the first tray having a first supporting surface facing upward in a vertical direction and configured to support a sheet;

a second tray assembled to the first tray, the second tray having a second supporting surface facing upward in the vertical direction and configured to support the sheet thereon in association with the first supporting surface, the first tray having a first guide portion which is formed at a central part, in a second direction which is a direction perpendicular to a first direction and parallel to the first supporting surface, of the first tray, the first direction being parallel to the first supporting surface, the first guide portion being configured to guide a slide movement of the second tray with respect to the first tray in the first direction, at least one first separation regulating part being formed on the first guide portion, the second tray having a second guide portion which is formed at a central part, in the second direction, of the second tray, the second guide portion being configured to slidably contact the first guide portion to guide the slide movement of the second tray with respect to the first tray at least one second separation regulating part being formed on the second guide portion, wherein the at least one first separation regulating part and the at least one second separation regulating part are configured to engage with each other in the vertical direction to prevent separation of the second tray, in an up-down direction which is a direction perpendicular to the first supporting surface, with respect to the first tray exceeding a particular dimension, and wherein first end regulating parts are provided to both ends, in the second direction, of the first tray, and second end regulating parts are provided to both ends, in the second direction, of the second tray, the first end regulating parts engaging with the second end regulating parts, respectively, so as to guide a sliding movement of the second tray, in the first direction, with respect to the first tray, the first end regulating parts and the second end regulating parts prevent separation of the second tray, in the up-down direction, which is a direction perpendicular to the first supporting surface, with respect to the first tray exceeding a particular dimension.

2. The sheet tray according to claim 1, wherein the second separation regulating part and the second guide portion provided to the second tray are formed at least on a retreating side, in a first direction, of the second tray, the first direction being a direction along which the second tray is slidable with respect to the first tray, the second tray being moved away from the first tray when the second tray slides toward an advancing side in the first direction, the retreating side being an opposite side, in the first direction, to the advancing side.

3. The sheet tray according to claim 2, wherein a protruded part protruding toward the retreating side in the first direction is formed on the retreating side, in the first direction, of a central part, in the second direction, of the second tray; and wherein the second guide portion and the second separation regulating part are provided to the protruded part.

4. The sheet tray according to claim 1, wherein at least one of:

the first guide portion extends, in the first direction, over an entire dimension of the first tray; and the second guide portion extends, in the first direction, over an entire dimension of the second tray.

5. The sheet tray according to claim 1, wherein a stopper is provided to the first tray, the stopper being configured to collide with a collided part provided to the second tray as the second tray is moved away, toward an advancing side in the first direction, with respect to the first tray, a further movement of the second tray toward the advancing side in the first direction with respect to the first tray being prevented when the stopper collides with the collided part.

6. The sheet tray according to claim 1, wherein each of the first guide portion and the second guide portion is provided with a first ridge and a second ridge, the first ridge of the first guide portion and the first ridge of the second guide portion contacting each other to restrict moving of the second tray with respect to the first tray in the second direction, the at least first separation regulating part being formed on the second ridge of the first guide portion, and the at least second separation regulating part being formed on the second ridge of the second guide portion, wherein each of the first ridge and the second ridge of the first guide portion extends over an entire dimension, in the first direction, of the first guide portion, and wherein each of the first ridge and the second ridge of the second guide portion extends over an entire dimension, in the first direction, of the second guide portion.

7. The sheet tray according to claim 1, wherein a dimension of the second tray in the second direction is smaller than a dimension of the first tray in the second direction.

8. The image forming apparatus according to claim 1, wherein the sheet tray is rotatably assembled at the sheet feed port of the main body such that the sheet tray is rotatable between a closed position at which the sheet tray covers the sheet feed port and an opened position at which the sheet tray uncovers the sheet feed port, wherein the first supporting surface and the second supporting surface faces upward in the vertical direction when the sheet tray is located at the opened position, wherein the first guide portion is provided on a same side of the first supporting surface, and wherein the second guide portion is formed to be recessed upward from a lower surface, which faces downward in the vertical direction, of the second tray.

9. The sheet tray according to claim 1, wherein a sliding direction in which the second tray moves away from the first tray in the first direction is referred to as an advancing side in the first direction and a direction opposite to the advancing direction in the first direction is referred to as a retreating side in the first direction;

wherein the second tray is arranged on an upside with respect to the first tray when the first tray is located at an open position; and wherein the first tray forms an appearance of the main body when the first tray is located at a closed position.

10. The sheet tray according to claim 1, further comprising a plate rotatable tray rotatable in a direction parallel to the second supporting surface, the plate rotatable tray being rotatably secured to an end portion on the advancing side in the first direction of the second tray.

11. The sheet tray according to claim 10, wherein an enclosure configured to accommodate the plate rotatable tray is provided to the end portion on the advancing side in the first direction of the second tray, and wherein the plate rotatable tray is configured to rotate between an accommodated position at which the plate rotatable tray is accommodated in the enclosure and a supported position which is shifted from the accommodated position.

12. The sheet tray according to claim 11, wherein the first tray is provided with a slidable part configured to slidably contact a sliding contact part provided to the plate rotatable tray, the slidable part being configured to covert a contact force generated at a contacting position where the slidable part and sliding contact part contact to a rotational force to rotate the plate rotatable tray from the supported position to the accommodated position.

13. A sheet tray, comprising:

a first tray having a first supporting surface facing upward in a vertical direction and configured to support a sheet; and a second tray assembled to the first tray such that the second tray is slidable with respect to the first tray in a first direction which is a direction parallel to the first surface, the second tray having a second supporting surface facing upward in the vertical direction and configured to support the sheet thereon;

wherein a sliding direction in which the second tray moves away from the first tray in the first direction is referred to as an advancing side in the first direction and a direction opposite to the advancing direction in the first direction is referred to as a retreating side in the first direction, and the sheet tray further comprises a plate rotatable tray rotatable within a plane parallel to the second supporting surface, the plate rotatable tray being rotatably secured to an end portion on the advancing side in the first direction of the second tray;

wherein an enclosure configured to accommodate the plate rotatable tray is provided to the end portion on the advancing side in the first direction of the second tray;

wherein the plate rotatable tray is configured to rotate between an accommodated position at which the plate rotatable tray is accommodated in the enclosure and a supported position which is shifted from the accommodated position;

wherein, when the second tray separated from the first tray slides toward the retreating side in the first direction, the plate rotatable tray rotates, in association with sliding movement of the second tray, from the supported position to the accommodated position; and wherein the first tray is provided with a slidable part configured to slidably contact a sliding contact part provided to the plate rotatable tray, the slidable part being configured to covert a contact force generated at a contacting position where the slidable part and sliding contact part contact to a rotational force to rotate the plate rotatable tray from the supported position to the accommodated position.

* * * * *